US011319911B2

(12) United States Patent
Saizen et al.

(10) Patent No.: US 11,319,911 B2
(45) Date of Patent: May 3, 2022

(54) FUEL INJECTION VALVE

(71) Applicant: DENSO CORPORATION, Kariya (JP)

(72) Inventors: Makoto Saizen, Kariya (JP); Shuichi Matsumoto, Kariya (JP); Keita Imai, Kariya (JP); Moriyasu Goto, Nisshin (JP)

(73) Assignee: DENSO CORPORATION, Kariya (JP)

( * ) Notice: Subject to any disclaimer, the term of this patent is extended or adjusted under 35 U.S.C. 154(b) by 502 days.

(21) Appl. No.: 16/508,369

(22) Filed: Jul. 11, 2019

(65) Prior Publication Data

US 2019/0331076 A1 Oct. 31, 2019

Related U.S. Application Data

(63) Continuation of application No. PCT/JP2018/002040, filed on Jan. 24, 2018.

(30) Foreign Application Priority Data

Jan. 27, 2017 (JP) ..... JP2017-013369
Mar. 3, 2017 (JP) ..... JP2017-040731
Nov. 29, 2017 (JP) ..... JP2017-229426

(51) Int. Cl.
*F02M 51/06* (2006.01)
*F02M 61/10* (2006.01)

(52) U.S. Cl.
CPC ..... *F02M 51/061* (2013.01); *F02M 61/10* (2013.01); *F02M 51/0678* (2013.01)

(58) Field of Classification Search
CPC ... F02M 51/061; F02M 61/10; F02M 51/0678
See application file for complete search history.

(56) References Cited

U.S. PATENT DOCUMENTS 7,926,469 B2 * 4/2011 Millet ..... F02M 45/12 123/509
2019/0277237 A1 * 9/2019 Imai ..... F02M 61/12
2021/0285412 A1 * 9/2021 Watanabe ..... F02M 51/066

FOREIGN PATENT DOCUMENTS

EP 2 975 256 1/2016

* cited by examiner

*Primary Examiner* — Phutthiwat Wongwian
*Assistant Examiner* — Arnold Castro
(74) *Attorney, Agent, or Firm* — Nixon & Vanderhye P.C.

(57) ABSTRACT

A fuel injection valve includes: a coil; a stationary core to generate a magnetic force; a movable structure including a moving core and a valve body and internally having a movable flow passage; and a body that internally accommodates the movable structure and internally has a part of the flow passage. The movable structure includes a throttle portion at which a passage area of the movable flow passage is partially throttled. The flow passage includes a throttle flow passage defined by the throttle portion and a separate flow passage between the movable structure and the body. A passage area of the separate flow passage is smaller than a passage area of the throttle flow passage. A position of the separate flow passage in a direction perpendicular to a moving direction of the movable structure is different from an outermost peripheral position of the moving core.

22 Claims, 15 Drawing Sheets

FUEL INJECTION VALVE

CROSS REFERENCE TO RELATED APPLICATION

The present application is a continuation application of International Patent Application No. PCT/JP2018/002040 filed on Jan. 24, 2018, which designated the U.S. and claims the benefit of priority from Japanese Patent Application No. 2017-13369 filed on Jan. 27, 2017, Japanese Patent Application No. 2017-40731 filed on Mar. 3, 2017, and Japanese Patent Application No. 2017-229426 filed on Nov. 29, 2017. The entire disclosures of all of the above applications are incorporated herein by reference.

TECHNICAL FIELD

The present disclosure relates to a fuel injection valve.

BACKGROUND

Conventionally, a fuel injection valve has been equipped to an internal combustion engine to inject fuel. A fuel injection valve includes a solenoid to manipulate a valve body.

SUMMARY

According to an aspect of the present disclosure, a fuel injection valve includes a coil to generate a magnetic flux on energization, a stationary core to form a path of the magnetic flux to generate a magnetic force, a moving core movable in response to the magnetic force, and a valve body movable with the moving core to open and close a nozzle hole. The moving core internally has a flow passage to cause fuel to flow therethrough.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
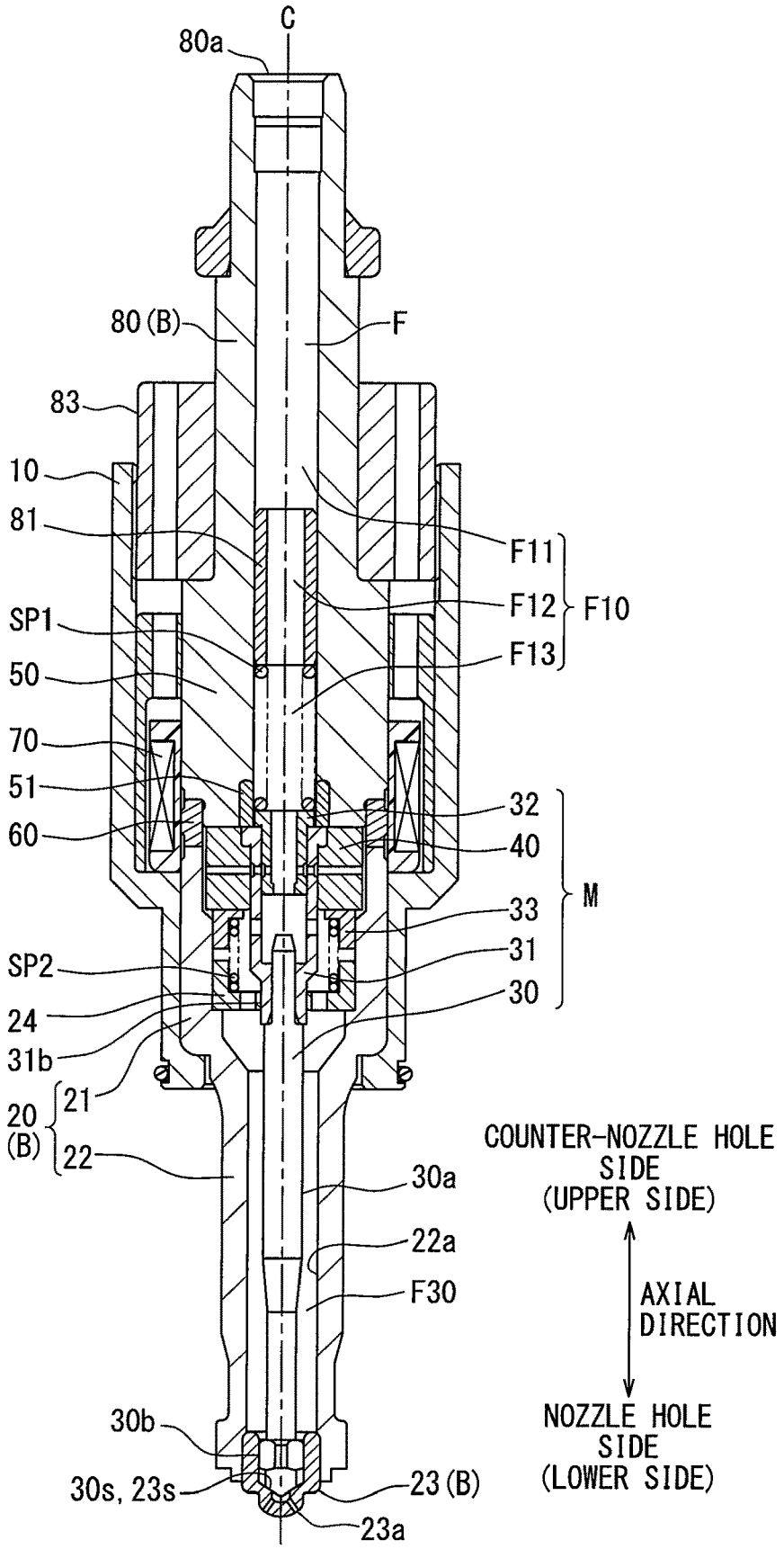
FIG. 1 is a cross-sectional view of a fuel injection valve according to a first embodiment of the present disclosure.

Hereinafter, an example of the present disclosure will be described.

A fuel injection valve according to the example includes a coil to generate a magnetic force on energization, a moving core movable by the magnetic force to cause a valve body attached to the moving core to open and close a nozzle hole.

It is noted that, as a valve opening speed of the valve body becomes higher, a slope of an injection amount characteristic representing a relationship between an energization period to the coil and the injection amount becomes larger.

In a conceivable configuration, a partial lift injection may be performed to start a valve closing operation before the valve body reaches a full lift position in order to reduce an injection amount by shortening the energization period. In the conceivable configuration, the valve opening speed could greatly affect the slope of the injection amount characteristic. Consequently, a variation in the injection amount with respect to the energization time could become large. Further, as the valve closing speed of the valve body becomes higher, the valve body could be likely to bounce on a seating surface. Consequently, an unintentional injection could occur accompanied with the bounce.

In consideration to appropriately control the valve opening speed and the valve closing speed of the valve body, an assumable configuration may be employable. Specifically, a through hole may be formed in the moving core to penetrate in a moving direction of the moving core. In addition, an orifice may be provided in the through hole. According to the assumable configuration, a fuel flowing through the through hole is throttled by the orifice, thereby to cause a braking force to act on the moving core. This assumable configuration is considered to enable to inhibit the valve body from bouncing on the seating surface by the action of the braking force on the valve body in a closing motion.

In the assumable structure, a boundary surface including the orifice and a sliding surface is divided into a pressure region (downstream region) on a nozzle hole side and a pressure region (upstream region) on a counter-nozzle hole side. When fuel flows through the orifice, a pressure difference is generated between the two regions. In the following description, one surface of the moving core to receive a fuel pressure from the upstream region is referred to as an upstream side pressure receiving surface, and the other surface of the moving core to receive the fuel pressure from the downstream region is referred to as a nozzle hole side pressure receiving surface.

In the assumable structure, the braking force acting on the valve body during the opening and closing operation can be specified in accordance with a difference between a value obtained by multiplying an area of the upstream side pressure receiving surface by a pressure in the upstream region and a value obtained by multiplying an area of the downstream side pressure receiving surface by a pressure in the downstream region. The braking force can be adjusted to a desired magnitude by adjusting the areas of the upstream side pressure receiving surface and the downstream side pressure receiving surface to adjust the degree of throttling by the orifice.

However, in the assumable configuration, the areas correlate to an outer diameter dimension of the moving core. Therefore, the outer diameter dimension of the moving core changes due to the adjustment of the areas. Consequently, the magnetic force acting on the moving core changes greatly. This fact makes it difficult to adjust the above areas for adjusting the braking force. For that reason, the adjustment of the braking force requires change in the degree of throttling of the orifice. Thus, it is difficult to adjust the degree of throttling so as to simultaneously satisfy multiple characteristics such as a pressure loss, the braking force, an unintentional valve opening due to pulsation, and the like.

SUMMARY

According to a first aspect of the present disclosure, a fuel injection valve has a nozzle hole configured to inject a fuel and a flow passage configured to cause the fuel to flow through the nozzle hole. The fuel injection valve comprises a coil configured to generate a magnetic flux on energization. The fuel injection valve further comprises a stationary core configured to form a path of the magnetic flux to generate a magnetic force. The fuel injection valve further comprises a movable structure that includes a moving core movable by the magnetic force and a valve body configured to be driven by the moving core to open and close the nozzle hole. The movable structure internally has a movable flow passage which is a part of the flow passage. The fuel injection valve further comprises a body that internally accommodates the movable structure in a movable state and internally has a part of the flow passage. The movable structure includes a throttle portion at which a passage area of the movable flow passage is partially throttled to regulate a flow rate. The flow passage includes a throttle flow passage defined by the throttle portion and a separate flow passage between the movable structure and the body to cause the fuel to flow independently of the throttle flow passage. A passage area of the separate flow passage is smaller than a passage area of the throttle flow passage. A position of the separate flow passage in a direction perpendicular to a moving direction of the movable structure is different from an outermost peripheral position of the moving core.

In the first aspect, the throttle flow passage and the separate flow passage are independent of each other, and the passage area of the separate passage is smaller than the passage area of the throttle flow passage. For that reason, the flow passage is divided into the upstream region and the downstream region with the throttle portion as a boundary. The upstream region is a region of the throttle portion on the upstream side of the fuel flow at the time of a full lift injection, and the downstream region is a region of the throttle portion on the downstream side of the fuel flow at the time of the full lift injection. When the movable structure is moved, the flow rate of the fuel is restricted in the throttle flow passage, so that a pressure difference is generated between the two regions. One surface of the movable structure to receive the fuel pressure from the upstream region to the valve closing side is called an upstream side pressure receiving surface, and another surface of the movable structure to receive the fuel pressure from the downstream region to the valve opening side is called a downstream side pressure receiving surface.

Further, according to the first aspect, the position of the separate flow passage in the direction perpendicular to the slidable direction of the movable structure is different from the outermost peripheral position of the moving core. For that reason, the areas of the upstream side pressure receiving surface and the downstream side pressure receiving surface can be adjusted while reducing an influence on the magnetic force. As described above, the braking force of the fuel applied to the moving movable structure is specified based on the area of the upstream side pressure receiving surface, the area of the downstream side pressure receiving surface, and the differential pressure between the two regions.

Therefore, according to the first aspect, the position of the separate flow passage is adjusted, thereby being capable of adjusting the area of the upstream side pressure receiving surface and the area of the downstream side pressure receiving surface while reducing the influence on the magnetic force. This makes it possible to adjust the braking force while reducing a change in the magnetic force acting on the moving core.

According to a second aspect of the present disclosure a fuel injection valve having a nozzle hole configured to inject a fuel and a flow passage configured to cause the fuel to flow through the nozzle hole. The fuel injection valve comprises a coil configured to generate a magnetic flux on energization. The fuel injection valve further comprises a stationary core configured to form a path of the magnetic flux to generate a magnetic force. The fuel injection valve further comprises a movable structure that includes a moving core movable by the magnetic force and a valve body configured to be driven by the moving core to open and close the nozzle hole. The movable structure internally has a movable flow passage which is a part of the flow passage. The fuel injection valve further comprises a body that internally accommodates the movable structure in a slidable state and internally has a part of the flow passage. The movable structure includes a throttle portion at which a passage area of the movable flow passage is partially throttled to regulate a flow rate and a sliding surface slidable with the body. The flow passage includes a throttle flow passage defined by the throttle. A position of the sliding surface in a direction perpendicular to a slidable direction of the movable structure is different from an outermost peripheral position of the moving core.

According to the second aspect, the flow passage is divided into an upstream region and a downstream region with the throttle portion as a boundary. The upstream region is a region of the throttle portion on the upstream side of the fuel flow at the time of a full lift injection, and the downstream region is a region of the throttle portion on the downstream side of the fuel flow at the time of the full lift injection. When the movable structure is moved, the flow rate of the fuel is restricted in the throttle flow passage, so that a pressure difference is generated between the two regions. In the following description, one surface of the movable structure to receive the fuel pressure from the upstream region to the valve closing side is called an upstream side pressure receiving surface, and another surface of the movable structure to receive the fuel pressure from the downstream region to the valve opening side is called a downstream side pressure receiving surface.

In the second aspect, the position of the separate flow passage in the direction perpendicular to the slidable direction of the movable structure is different from the outermost peripheral position of the moving core. For that reason, the areas of the upstream side pressure receiving surface and the downstream side pressure receiving surface can be adjusted while reducing an influence on the magnetic force. As described above, the braking force of the fuel applied to the moving movable structure is specified based on the area of the upstream side pressure receiving surface, the area of the downstream side pressure receiving surface, and the differential pressure between the two regions.

Therefore, according to the second aspect, the position of the sliding surface is adjusted, thereby being capable of adjusting the area of the upstream side pressure receiving surface and the area of the downstream side pressure receiving surface while reducing the influence on the magnetic force. This makes it possible to adjust the braking force while reducing a change in the magnetic force acting on the moving core.

In those ways, the configuration of the fuel injection valve enables to adjust a braking force acting on a valve body while reducing an influence on a magnetic force.

Hereinafter, multiple embodiments for carrying out the present disclosure will be described with reference to the drawings. In each embodiment, portions corresponding to those described in the preceding embodiment are denoted by the same reference numerals, and repetitive descriptions may be omitted in some cases. In each mode, when only a part of the configuration is described, the other parts of the configuration can be applied with reference to the other modes described above.

First Embodiment

A fuel injection valve shown in FIG. 1 is mounted on an ignition type internal combustion engine (gasoline engine), and injects a fuel directly into each combustion chamber of a multi-cylinder engine. The fuel to be supplied to the fuel injection valve is pumped by a fuel pump (not shown), and the fuel pump is driven by a rotational driving force of the engine. The fuel injection valve includes a case 10, a nozzle body 20, a valve body 30, a moving core 40, a stationary core 50, a non-magnetic member 60, a coil 70, a pipe connection portion 80, and the like.

The case 10 is made of metal and has a cylindrical shape extending in a direction (hereinafter referred to as an axis line direction) along which an annular center line C of the coil 70 extends. The annular center line C of the coil 70 coincides with center axis lines of the case 10, the nozzle body 20, the valve body 30, the moving core 40, the stationary core 50, and the non-magnetic member 60.

The nozzle body 20 is made of metal, and has a main body portion 21 which is inserted into the case 10 and engages with the case 10, and a nozzle portion 22 which extends from the main body portion 21 to the outside of the case 10. The nozzle portion 22 has a cylindrical shape extending in the axis line direction, and a nozzle hole member 23 is attached to a tip of the nozzle portion 22.

The nozzle hole member 23 is made of metal and is fixed to the nozzle portion 22 by welding. The nozzle hole member 23 has a bottomed cylindrical shape extending in the axis line direction, and a nozzle hole 23*a* for injecting the fuel is provided at a tip of the nozzle hole member 23. A seating surface 23*s* on and from which the valve body 30 is seated and unseated is formed on an inner peripheral surface of the nozzle hole member 23.

The valve body 30 is made of metal and has a cylindrical shape extending along the axis line direction. The valve body 30 is assembled inside the nozzle body 20 so as to be movable in the axis line direction, and an annular flow passage (downstream passage F30) extending in the axis line direction is provided between an outer peripheral surface 30*a* of the valve body 30 and an inner peripheral surface 22*a* of the nozzle body 20. An annular seat surface 30*s* is formed on an end portion of the valve body 30 on the nozzle hole 23*a* side so as to be unseated from and seated on the seating surface 23*s*.

A coupling member 31 is fixedly attached to an end portion of the valve body 30 opposite to the nozzle hole 23*a* (hereinafter referred to as an opposite to a counter-nozzle hole side) by welding or the like. Further, an orifice member 32 in which the orifice 32*a* (throttle portion) is provided and the moving core 40 are attached to an end portion of the coupling member 31 on the counter-nozzle hole side.

Figure 2:
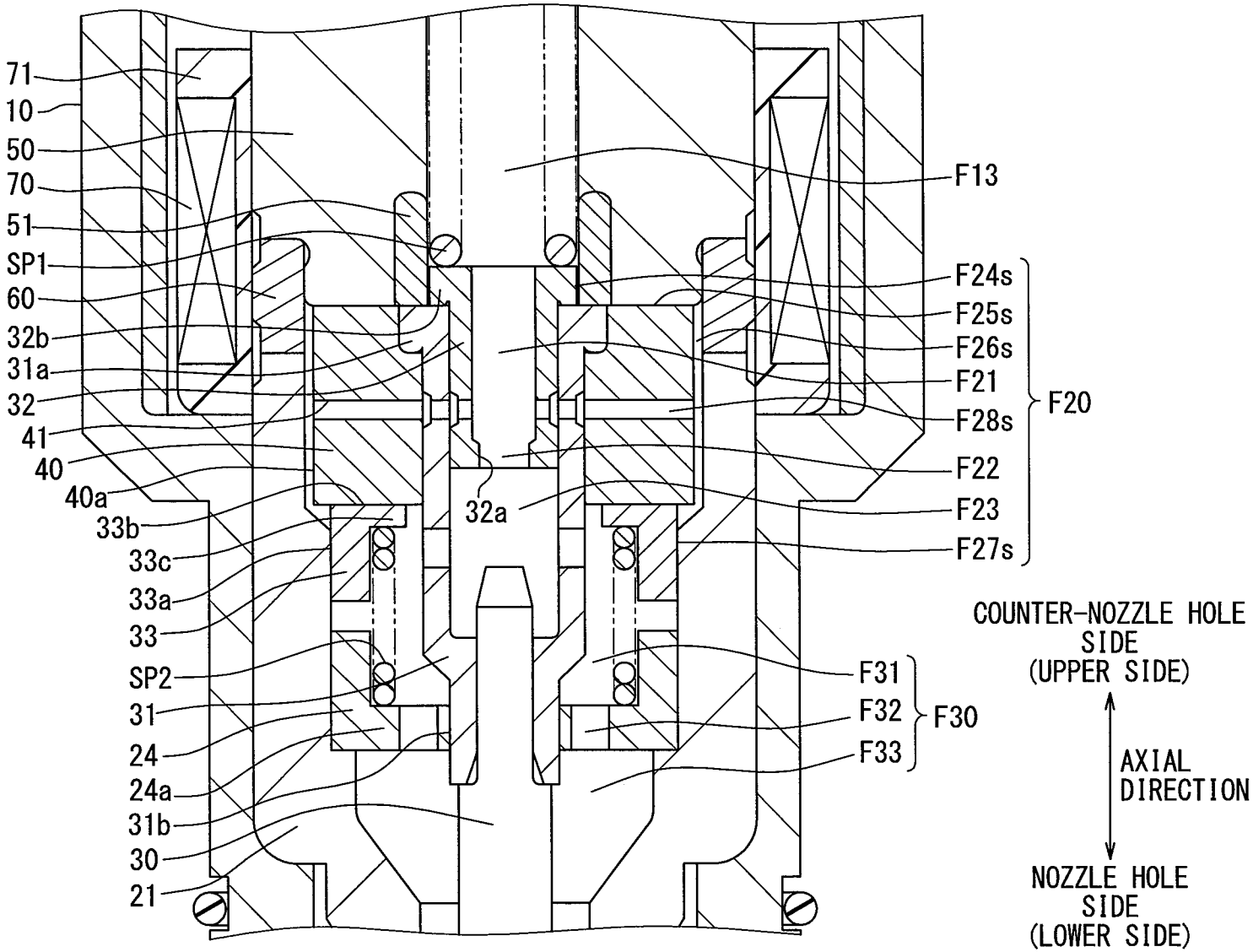
FIG. 2 is an enlarged cross-sectional view of FIG. 1.

As shown in FIG. 2, the coupling member 31 has a cylindrical shape extending in the axis line direction, the orifice member 32 is fixed to a cylinder inner peripheral surface of the coupling member 31 by welding or the like, and the moving core 40 is fixed to a cylinder outer peripheral surface of the coupling member 31 by welding or the like. An enlarged diameter portion 31*a* that expands in the radial direction is formed at the end portion of the coupling member 31 on the counter-nozzle hole side. The nozzle hole side end surface of the enlarged diameter portion 31*a* engages with the moving core 40, thereby preventing the coupling member 31 from escaping toward the nozzle hole side from the moving core 40.

The orifice member 32 has a cylindrical shape extending in the axis line direction, and the inside of the cylinder functions as a flow passage F21 through which the fuel flows. The orifice 32*a* (throttle portion) for throttling the flow rate by partially narrowing the passage area of the flow passage F21 is provided at an end portion of the orifice member 32 on the nozzle hole side. A portion of the flow passage F21 throttled by the orifice 32*a* is referred to as a throttle flow passage F22.

The throttle flow passage F22 is located on a center axis line of the valve body 30. A flow channel length of the throttle flow passage F22 is shorter than a diameter of the throttle flow passage F22. An enlarged diameter portion 32*b* that expands in the radial direction is formed at an end portion of the orifice member 32 on the counter-nozzle hole side. A nozzle hole side end surface of the enlarged diameter portion 32*b* on the nozzle hole side engages with the coupling member 31, thereby preventing the orifice member 32 from escaping toward the nozzle hole side from the coupling member 31.

The moving core 40 is formed in a disc shape and is made of metal, and is accommodated and located inside a cylinder of the main body portion 21. The moving core 40 moves in the axis line direction integrally with the coupling member 31, the valve body 30, the orifice member 32, and the sliding member 33. The moving core 40, the coupling member 31, the valve body 30, the orifice member 32, and the sliding member 33 correspond to a movable structure M that moves in the axis line direction integrally.

The sliding member 33 is separate from the moving core 40, and is pressed so as to be in close contact with the moving core 40 by an elastic force of a close contact elastic member SP2. The sliding member 33 is separate from the moving core 40 in this manner, thereby being capable of easily realizing that a material of the sliding member 33 is different from a material of the moving core 40. The moving core 40 is made of a material higher in magnetic strength than the sliding member 33, and the sliding member 33 is made of a material higher in abrasion resistance than the moving core 40.

The sliding member 33 has a cylindrical shape, and the cylinder outer peripheral surface of the sliding member 33 functions as a sliding surface 33*a* that slides on the inner peripheral surface of the main body portion 21. An outer diameter dimension of the sliding surface 33*a* is smaller than an outer diameter dimension of the moving core 40. In other words, the position of the sliding surface 33*a* in a direction perpendicular to the slidable direction of the sliding member 33 is located on an inner side of the outermost peripheral position of the moving core 40, that is, on a side of the annular center line C.

A surface of the sliding member 33 on the counter-nozzle hole side functions as a sealing surface 33*b* which is in close contact with a surface of the moving core 40 on the nozzle hole side and seals the surface of the moving core 40 so as not to allow the passage of the fuel. A coil-shaped close contact elastic member SP2 is located inside the cylinder of the sliding member 33. The close contact elastic member SP2 deforms in the axis line direction to impart an elastic force to the sliding member 33, and the sealing surface 33*b* of the sliding member 33 is resiliently pressed against a surface of the moving core 40 on the nozzle hole side and brought in close contact with the surface of moving core 40.

A reduced diameter portion 33*c* that reduces in the radial direction is formed at the end portion of the sliding member 33 on the counter-nozzle hole side. An upper surface of the reduced diameter portion 33*c* functions as a part of the sealing surface 33*b*, and a lower surface of the reduced diameter portion 33*c* supports one end of the close contact elastic member SP2. A support member 24 is fixed to a bottom surface of the main body portion 21, and a reduced diameter portion 24*a* that reduces in the radial direction is formed in the support member 24. The other end of the close contact elastic member SP2 is supported by the reduced diameter portion 24*a*.

The sliding member 33 is in a state of being movable relative to the moving core 40 in the radial direction. In a portion of the movable structure M excluding the sliding member 33, a guide portion for supporting the movable structure M in the radial direction while sliding the movable structure M so as to be movable in the axis line direction relative to the nozzle body 20 is provided. The guide portions are provided at two places in the axis line direction, and the guide portion located on the nozzle hole 23*a* side in the axis line direction is called a nozzle hole side guide portion 30*b*, and the guide portion located on the counter-nozzle hole side is called a counter-nozzle hole side guide portion 31*b* (refer to FIGS. 1 and 2). The nozzle hole side guide portion 30*b* is formed on an outer peripheral surface of the valve body 30, and is slidably supported on an inner peripheral surface of the nozzle hole member 23. The counter-nozzle hole side guide portion 31*b* is formed on an outer peripheral surface of the coupling member 31, and is slidably supported on an inner peripheral surface of the support member 24.

The stationary core 50 is fixedly located inside the case 10. The stationary core 50 is made of an annular metal extending around the axis line direction. The non-magnetic member 60 is an annular member located between the stationary core 50 and the main body portion 21, and is made of a material lower in magnetism than the stationary core 50 and the moving core 40. On the other hand, the stationary core 50, the moving core 40, and the main body portion 21 are made of a material having magnetism.

A cylindrical stopper 51 made of metal is fixed to an inner peripheral surface of the stationary core 50. The stopper 51 is in contact with the coupling member 31 to restrict the coupling member 31 from moving to the counter-nozzle hole side. In a state in which an upper end face of the enlarged diameter portion 31*a* of the coupling member 31 is in contact with a lower end surface of the stopper 51, a lower end surface of the stationary core 50 is out of contact with an upper end surface of the moving core 40, and a predetermined gap is defined between the lower end face and the upper end surface.

The coil 70 is located the radially outer side of the non-magnetic member 60 and the stationary core 50. The coil 70 is wound around a bobbin 71 made of resin. The bobbin 71 has a cylindrical shape centered on the axis line direction. Therefore, the coil 70 is located in an annular shape extending around the axis line direction.

On the counter-nozzle hole side of the stationary core 50, the pipe connection portion 80 is located, which provides an inflow port 80*a* of the fuel and is connected to an external pipe. The pipe connection portion 80 is made of metal, and is formed of a metal member integral with the stationary core 50. The fuel pressurized by a high-pressure pump is supplied from the inflow port 80*a* to the fuel injection valve. A flow passage F11 extending in the axis line direction is provided inside the pipe connection portion 80, and a press-fitting member 81 is press-fitted and fixed to the flow passage F11.

An elastic member SP1 is located on the nozzle hole side of the press-fitting member 81. One end of the elastic member SP1 is supported by the press-fitting member 81, and the other end of the elastic member SP1 is supported by the enlarged diameter portion 32*b* of the orifice member 32. Therefore, according to the press-fit amount of the press-fitting member 81, that is, the fixation position in the axis line direction, an elastic deformation amount of the elastic member SP1 when the valve body 30 is opened to the full lift position, that is, when the coupling member 31 abuts on the stopper 51 is specified. In other words, the valve closing force (set load) by the elastic member SP1 is adjusted by the press-fit amount of the press-fitting member 81.

A fastening member 83 is located on an outer peripheral surface of the pipe connection portion 80. The fastening member 83 is fastened to the case 10 by fastening an external threaded portion formed on the outer peripheral surface of the fastening member 83 to an internal thread formed on an inner peripheral surface of the case 10. The pipe connection portion 80, the stationary core 50, the non-magnetic member 60, and the main body portion 21 are sandwiched between a bottom surface of the case 10 and the fastening member 83 by an axial force generated by the fastening.

The pipe connection portion 80, the stationary core 50, the non-magnetic member 60, the nozzle body 20, and the nozzle hole member 23 correspond to a body B having a flow passage F for allowing the fuel supplied to the inflow port 80*a* to flow through the nozzle hole 23*a*. The movable structure M described above is accommodated inside the body B in a slidable state.

Next, the operation of the fuel injection valve will be described.

When the coil 70 is energized, a magnetic field is generated around the coil 70. That is, a magnetic field circuit in which a magnetic flux passes through the stationary core 50, the moving core 40, and the main body portion 21 is formed along with energization, and the moving core 40 is attracted to the stationary core 50 by a magnetic force generated by the magnetic circuit. The valve closing force by the elastic member SP1, the valve closing force by the fuel pressure, and the valve opening force by the magnetic force described above act on the movable structure M. Since the valve opening force is set to be larger than the valve closing force, when the magnetic force is generated in association with the energization, the moving core 40 moves toward the stationary core 50 together with the valve body 30. As a result, the valve body 30 is opened, the seat surface 30*s* is unseated from the seating surface 23*s*, and the high-pressure fuel is injected from the nozzle hole 23*a*.

When the energization of the coil 70 is stopped, the valve opening force due to the magnetic force described above is eliminated, so that the valve body 30 together with the moving core 40 is operated to close the valve by the valve closing force due to the elastic member SP1, and the seat surface 30*s* is seated on the seating surface 23*s*. As a result, the valve body 30 is operated to close the valve, and the fuel injection from the nozzle hole 23*a* is stopped.

Next, a flow of the fuel when the fuel is injected from the nozzle hole 23*a* will be described.

The high-pressure fuel supplied from the high-pressure pump to the fuel injection valve flows in from the inflow port 80*a*, and flows in order through the flow passage F11 along a cylinder inner peripheral surface of the pipe connection portion 80, a flow passage F12 along a cylinder inner peripheral surface of the press-fitting member 81, and a flow passage F13 in which the elastic member SP1 is accommodated (refer to FIG. 1). Those flow passages F11, F12, and F13 are collectively referred to as an upstream passage F10, and the upstream passage F10 is located outside and upstream side of the movable structure M in the entire flow passage F existing inside the fuel injection valve. The flow passage provided by the movable structure M in the entire flow passage F is referred to as a movable flow passage F20, and the flow passage located on the downstream side of the movable flow passage F20 is referred to as a downstream passage F30.

The movable flow passage F20 branches the fuel flowing out of the flow passage F13 into a main passage and a sub-passage. The main passage and the sub-passage are located independently of each other. More specifically, the main passage and the sub-passage are located in parallel, and the fuel which branches and flows into the main passage and the sub-passage joins in the downstream passage F30.

The main passage is a passage through which the fuel flows in the order of the flow passage F21 along a cylinder inner peripheral surface of the orifice member 32, the throttle flow passage F22 by the orifice 32*a*, and a flow passage F23 along a cylindrical inner peripheral surface of the coupling member 31. The fuel in the flow passage F23 flows into the downstream passage F30, which is a flow passage F31 along the cylinder outer peripheral surface of the coupling member 31, through the through hole penetrating the coupling member 31 in the radial direction.

The sub-passage is a passage through which the fuel flows in the order of a flow passage F24*s* along a cylinder outer peripheral surface of the orifice member 32, a flow passage F25*s* which is a gap between the moving core 40 and the stationary core 50, a flow passage F26*s* along an outer peripheral surface 40*a* of the moving core 40, and a flow passage along the sliding surface 33*a*. The flow passage along the sliding surface 33*a* is called a sliding flow passage F27*s* or a separate flow passage, and the fuel in the sliding flow passage F27*s* flows into the downstream passage F30, which is the flow passage F31 along the cylinder outer peripheral surface of the coupling member 31. A passage area of the flow passage F26*s* provided between an outermost periphery of the moving core 40 and the main body portion 21 is larger than a passage area of the sliding flow passage F27*s*. In other words, the degree of throttling in the sliding flow passage F27*s* is set to be larger than the degree of throttling in the flow passage F26*s*.

In this example, the upstream side of the sub-passage is connected to the upstream side of the throttle flow passage F22. More specifically, a portion of the sliding flow passage F27*s* (separate flow passage) on the counter-nozzle hole side is connected to the flow passage on the counter-nozzle hole side of the throttle flow passage F22. The downstream side of the sub-flow channel is connected to the downstream side of the throttle flow passage F22. Specifically, a portion of the sliding flow passage F27*s* (separate flow passage) on the nozzle hole side is connected to the flow passage on the nozzle hole side of the throttle flow passage F22. In other words, the sub-flow channel connects the upstream side and the downstream side of the throttle flow passage F22 without passing through the throttle flow passage F22. The sliding flow passage F27*s* (separate flow passage) is provided closer to the nozzle hole than the moving core 40.

In short, the fuel which has flowed into the movable flow passage F20 from the flow passage F13, which is the upstream passage F10, branches into the flow passage F21, which is the upstream end of the main passage, and the flow passage F24*s*, which is the upstream end of the sub-passage, and thereafter, the fuel joins in the flow passage F31 which is the downstream passage F30.

Each of the moving core 40, the coupling member 31, and the orifice member 32 is formed with a through hole 41 penetrating in the radial direction. Those through holes 41 function as a flow passage F28*s* for communicating the flow passage F21 along the inner peripheral surface of the orifice member 32 with the flow passage F26*s* along the outer peripheral surface of the moving core 40. The flow passage F28*s* is a passage that ensures the flow rate of the fuel flowing through the sliding flow passage F27*s*, that is, the flow rate of the sub-passage when the coupling member 31 abuts on the stopper 51 to cut off the communication between the flow passage F24*s* and the flow passage F25*s*. Since the flow passage F28*s* is located on the upstream side of the throttle flow passage F22, the flow passages F25*s*, the F26*s*, and the F28*s* become upstream regions, and a pressure difference from the downstream region occurs.

The fuel flowing out of the movable flow passage F20 flows into the flow passage F31 along the cylinder outer peripheral surface of the coupling member 31, and then flows through a flow passage F32, which is a through hole that passes through the reduced diameter portion 24*a* of the support member 24 in the axis line direction, and a flow passage F33 along the outer peripheral surface of the valve body 30 in a stated order (refer to FIG. 2). When the valve body 30 is opened, the high-pressure fuel in the flow passage F33 passes between the seat surface 30*s* and the seating surface 23*s* and is injected from the nozzle hole 23*a*.

The flow passage along the sliding surface 33*a* described above is called the sliding flow passage F27*s*, and a passage area of the sliding flow passage F27*s* is smaller than a passage area of the throttle flow passage F22. In other words, the degree of throttling in the sliding flow passage F27*s* is set to be larger than the degree of throttling in the throttle flow passage F22. The passage area of the throttle flow passage F22 is the smallest in the main passage, and the passage area in the sliding flow passage F27*s* is the smallest in the sub-passage.

Therefore, in the main passage and the sub-passage in the movable flow passage F20, the main passage is easier to flow, the degree of throttling in the main passage is specified by the degree of throttling in the orifice 32*a*, and the flow rate of the main passage is adjusted by the orifice 32*a*. In other words, the degree of throttling in the movable flow passage F20 is specified by the degree of throttling in the orifice 32*a*, and the flow rate of the movable flow passage F20 is adjusted by the orifice 32*a*.

The passage area of the flow passage F in the full lift state where the valve body 30 has moved most in the valve opening direction, which is the passage area of the flow passage F on the seat surface 30*s*, is referred to as a seat passage area. The passage area of the throttle flow passage F22 by the orifice 32*a* is set to be larger than the seat passage area. In other words, the degree of throttling by the orifice 32*a* is set to be smaller than the degree of throttling at the seat surface 30*s* at the time of full lift.

The seat passage area is set to be larger than the passage area of the nozzle hole 23*a*. In other words, the degree of throttling by the orifice 32*a* and the degree of throttling at the seat surface 30*s* are set to be smaller than the degree of throttling by the nozzle hole 23*a*. When multiple nozzle holes 23*a* are provided, the seat passage area is set to be larger than a sum total passage area of all the nozzle holes 23*a*.

Next, a braking force received by the movable structure M from the fuel when the movable structure M moves will be described.

In the present embodiment, the throttle flow passage F22 and the sliding flow passage F27*s* are located in parallel, and the passage area of the sliding flow passage F27*s* is set to be smaller than the passage area of the throttle flow passage F22. For that reason, the flow passage F is divided into an upstream region and a downstream region with the orifice 32*a* (throttle portion) and the sliding flow passage F27*s* as a boundary.

The upstream region is a region on the upstream side of the orifice 32*a* in the fuel flow at the time of injection. The upstream side of the sliding surface 33*a* in the movable flow passage F20 also belongs to the upstream region. Therefore, the flow passages F21, F24*s*, F25*s*, F26*s*, F28*s* of the movable flow passage F20 and the upstream passage F10 correspond to an upstream region. The downstream region is a region on the downstream side of the orifice 32*a* in the fuel flow at the time of injection. The downstream side of the sliding surface 33*a* in the movable flow passage F20 also belongs to the downstream region. Therefore, the flow passage F23 and the downstream passage F30 of the movable flow passage F20 correspond to the downstream region.

In short, when the fuel flows through the throttle flow passage F22, the flow rate of the fuel flowing through the movable flow passage F20 is throttled by the orifice 32*a*, so that a pressure difference occurs between the fuel pressure in the upstream region (that is, an upstream fuel pressure PH) and the fuel pressure in the downstream region (that is, a downstream fuel pressure PL). Therefore, when the valve body 30 is changed from a valve close state to a valve open state, when the valve body 30 is changed from the valve open state to the valve close state, and when the valve body 30 is held at the full lift position, the fuel flows through the throttle flow passage F22, and the pressure difference is generated.

The pressure difference caused by the opening of the valve body 30 is not eliminated at the same time as the valve is switched from the open state to the closed state, and when a predetermined time elapses after the valve has been closed, the upstream fuel pressure PH and the downstream fuel pressure PL become the same as each other. On the other hand, when the valve is switched from the closed state to the open state in a state in which the pressure difference does not occur, the pressure difference immediately occurs at the timing of the switching.

Figure 3:
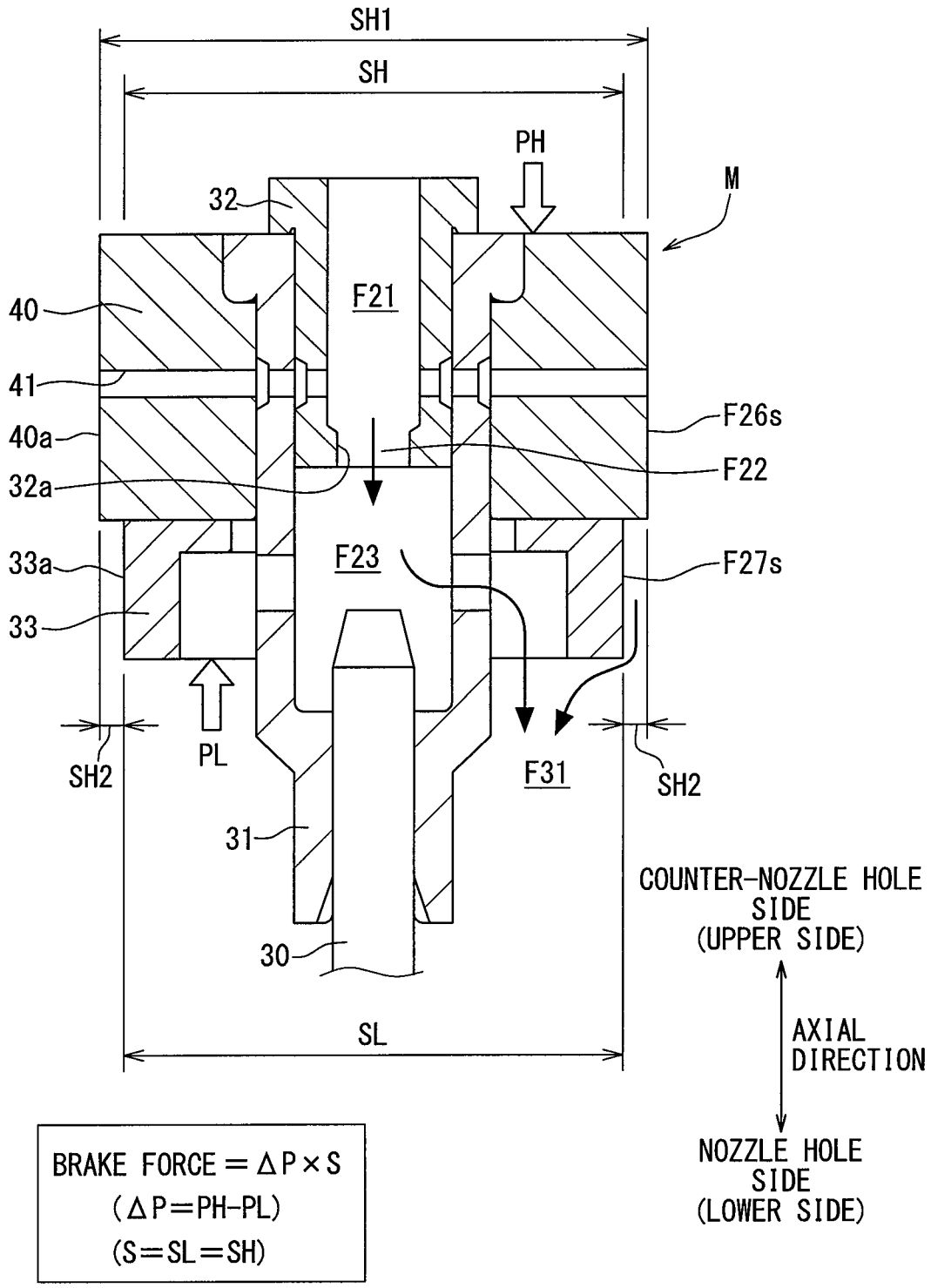
FIG. 3 is a cross-sectional view of a movable structure M according to the first embodiment.

As shown in FIG. 3, when the movable structure M moves, a surface of the movable structure M which receives the upstream fuel pressure PH on the valve closing side is referred to as an upstream side pressure receiving surface SH, and a surface of the movable structure M which receives the downstream fuel pressure PL on the valve opening side is referred to as a downstream side pressure receiving surface SL.

An apparent upstream side pressure receiving surface SH1 corresponds to upper end faces of the moving core 40, the coupling member 31, and the orifice member 32, which are exposed in the upstream region. However, since the sliding surface 33*a* serving as the boundary between both of those regions is located on the radially inner side of the outer peripheral surface 40*a* of the moving core 40, a pressure receiving surface SH2 located outside the sliding surface 33*a* of the lower end face of the moving core 40 receives the upstream fuel pressure PH in the valve opening direction. Therefore, it is conceivable that an area obtained by subtracting the area of the pressure receiving surface SH2 receiving the fuel pressure in the valve opening direction from the apparent area of the upstream side pressure receiving surface SH1 is a substantial area of the upstream side pressure receiving surface SH.

The downstream side pressure receiving surface SL corresponds to lower end faces of the sliding member 33, the coupling member 31, and the orifice member 32, which are surfaces of portions exposed in the downstream region. The area of the downstream side pressure receiving surface SL is the same as that of the upstream side pressure receiving surface SH.

A value obtained by multiplying the upstream side pressure receiving surface SH by the upstream fuel pressure PH corresponds to a force acting on the movable structure M on the valve closing side, and a value obtained by multiplying the downstream side pressure receiving surface SL by the downstream fuel pressure PL corresponds to a force acting on the movable structure M on the valve opening side. A difference between those forces acts as a braking force on the moving movable structure M.

During the movement of the movable structure M in the valve opening direction, the fuel in the upstream region is pushed and compressed by the movable structure M, so that the upstream fuel pressure PH rises. On the other hand, since the fuel in the upstream region pushed by the movable structure M is pushed out to the downstream region while being throttled by the orifice 32*a*, the downstream fuel pressure PL becomes lower than the upstream fuel pressure PH. Therefore, the braking force due to a pressure difference $\Delta P$ between both of those regions acts in a direction in which the movable structure M moving in the valve opening direction is pushed back in the valve closing direction. In short, at the time of the valve opening operation, the fuel flows through the throttle flow passage F22 to the nozzle hole side, and a force obtained by multiplying the pressure difference $\Delta P$ generated by throttling at that time by the area S of the upstream side pressure receiving surface SH or the downstream side pressure receiving surface SL acts on the movable structure M as the braking force.

During the movement of the movable structure M in the valve closing direction, the fuel in the downstream region is pushed and compressed by the movable structure M, so that the downstream fuel pressure PL rises. On the other hand, since the fuel in the downstream region pushed by the movable structure M is pushed out to the upstream region while being throttled by the orifice 32*a*, the upstream fuel pressure PH becomes lower than the downstream fuel pressure PL. Therefore, the braking force due to the pressure difference ΔP between both of those regions acts in a direction in which the movable structure M moving in the valve closing direction is pushed back in the valve opening direction. In short, at the time of the valve closing operation, the fuel flows through the throttle flow passage F22 to the counter-nozzle hole side, and a force obtained by multiplying the pressure difference ΔP generated by throttling at that time by the area S acts on the movable structure M as the braking force.

Therefore, at least one of the degree of throttling by the orifice 32*a* and the area S is adjusted, thereby being capable of adjusting the braking force. A size of the area S can be adjusted by adjusting a diameter dimension of the sliding surface 33*a*.

Next, the operation and effects of the configuration employed in the present embodiment will be described.

According to the present embodiment, the throttle flow passage F22 and the sliding flow passage F27*s* are located in parallel, and the passage area of the sliding flow passage F27*s* is set to be smaller than the passage area of the throttle flow passage F22. For that reason, the flow passage F is divided into an upstream region and a downstream region with the orifice 32*a* (throttle portion) as a boundary. At the time of the movement of the movable structure M, the flow rate of the fuel is throttled in the throttle flow passage F22, so that a pressure difference ΔP occurs between the two regions, and the braking force acts on the movable structure M due to the pressure difference ΔP.

For that reason, since the braking force acts on the movable structure M which is operated to close the valve, the valve body 30 can be inhibited from bouncing at the seating surface 23*s*, and the possibility of an injection state which is not intended can be reduced. In addition, since the braking force acts on the movable structure M which is operated to open the valve, an impact when the coupling member 31 collides with the stopper 51 can be alleviated, and the wear of the coupling member 31 and the stopper 51 can be reduced.

In addition, according to the present embodiment, a position of the sliding surface 33*a* in the direction perpendicular to the slidable direction (that is, in the radial direction) of the movable structure M is different from the outermost peripheral position of the moving core 40. For that reason, an areas S of the upstream side pressure receiving surface SH and the downstream side pressure receiving surface SL can be adjusted without changing the outermost peripheral position of the moving core 40. Therefore, the position of the sliding surface 33*a* is adjusted, thereby being capable of the above area S without changing the outermost peripheral position of the moving core 40. Therefore, the braking force can be adjusted without causing a large change in the magnetic force acting on the moving core 40.

Further, in the present embodiment, the through hole 41 are provided in the moving core 40 so as to communicate the upstream portion of the throttle flow passage F22 with the upstream portion of the sliding flow passage F27*s*. For that reason, even when the orifice member 32 comes into contact with the stopper 51 and a communication between the flow passage F24*s* and the flow passage F25*s* is cut off, the fuel can be sent to the pressure receiving surface SH2 receiving the upstream fuel pressure PH in the valve opening direction through the through hole 41. This makes it possible to improve the reliability of setting the substantial area of the upstream side pressure receiving surface SH to a desired size.

Further, in the present embodiment, a material of the sliding member 33 forming the sliding surface 33*a* is different from a material of the moving core 40. For that reason, the sliding surface 33*a* can be made of a material with high durability priority, and the moving core 40 can be made of a material with low magnetoresistance priority.

Further, in the present embodiment, the throttle flow passage F22 is located on the center axis line of the valve body 30. According to the above configuration, even if the position of the orifice 32*a* (throttle portion) in the direction perpendicular to the central axis (that is, in the radial direction) is deviated from the desired position, a fluid resistance received by the orifice 32*a* acts at a position close to the center axis line. On the other hand, contrary to the present embodiment, when multiple throttle flow passages are placed at positions deviating from the center axis line so as to be targeted, a fluid resistance acts on the movable structure M as a tilting force due to a positional deviation of the throttle flow passages. Therefore, according to the present embodiment in which the throttle flow passage F22 is positioned on the center axis line of the valve body 30, the tilting force acting on the movable structure M can be reduced.

Further, in the present embodiment, the movable structure M includes a close contact elastic member SP2 that presses the sliding member 33 forming the sliding surface 33*a* against the moving core 40 in a close contact manner. According to the above configuration, since the gap between the sliding member 33 and the moving core 40 can be sealed without fixing the sliding member 33 to the moving core 40, the sliding member 33 can divide the flow passage F into the upstream region and the downstream region in a state of being movable in the radial direction relative to the moving core 40. If the sliding member 33 is fixed to the moving core 40 contrary to the present embodiment, the axis center of the sliding member 33 and the axis center of the moving core 40 are required to coincide with each other with high accuracy. However, according to the present embodiment, since the fixing is unnecessary, the dimensional accuracy required for the movable structure M can be relaxed.

In addition, according to the present embodiment, the valve body 30 is secured to the moving core 40 in a relatively immobile condition. Contrary to the present embodiment, when the valve body is assembled to the moving core in a state of being movable relative to the moving core 40, the following possibility arises. In other words, although the bounce is less likely to occur because the moving core relatively moves immediately after the valve has been closed, the next injection cannot be started until the moving core relatively moves to a standstill, which may hinder the realization of injection in a short interval.

On the other hand, in the present embodiment, since the valve body 30 is fixed to the moving core 40 in a state in which the relative movement is disabled, the short interval can be prevented from being hindered by waiting until the relative movement of the moving core stops. In addition, since the above-mentioned effects that the braking force can be adjusted by setting the position of the sliding surface 33*a* in the radial direction to be different from the outermost peripheral position of the moving core 40 are exhibited, a bounce reduction of the valve body 30 can also be achieved. In other words, both of the short interval and the bounce reduction can be achieved.

Further, according to the present embodiment, the outermost diameter dimension of the sliding surface 33*a* is smaller than the outermost diameter dimension of the moving core 40. In other words, the sliding flow passage F27*s* is provided inside the outermost peripheral position of the moving core 40. In recent years, there has been a tendency to increase the pressure of the fuel supplied to the fuel injection valve, and accordingly, a hydraulic pressure acting on the valve body 30 increases, which in turn tends to increase a magnetic attraction force required for opening the valve. For that reason, an outer diameter dimension of the moving core 40 tends to be increased. Therefore, contrary to the present embodiment, if the outermost diameter position of the moving core 40 is made to function as the sliding surface, the area of the downstream side pressure receiving surface SL may become larger than necessary, and the braking force may become larger than necessary. On the other hand, in the present embodiment, since the sliding surface 33*a* is provided at a position different from the outermost diameter position of the moving core 40, and the outermost diameter dimension of the sliding surface 33*a* is set to be smaller than the outermost diameter dimension of the moving core 40, the above possibility can be reduced.

Second Embodiment

A movable structure M1 of a fuel injection valve according to the present embodiment has a variable throttle mechanism that changes the degree of regulating of a flow rate in a flow passage F. The variable throttle mechanism includes the orifice member 32 (a fixed member) similar to that of the first embodiment, a moving member 100, and a pressing elastic member SP3. The moving member 100 is located in the flow passage F23 inside the coupling member 31 so as to be movable relative to the orifice member 32 in the axis line direction.

The moving member 100 is made of metal and is formed in a cylindrical shape extending in the axis line direction, and is located on the downstream side of the orifice member 32. A through hole penetrating in the axis line direction is provided in a cylindrical center portion of the moving member 100. The through hole is a part of the flow passage F, communicates with the throttle flow passage F22, and functions as a sub-throttle flow passage 103 having a passage area smaller than that of the throttle flow passage F22. The moving member 100 has a sealing portion 101 formed with a sealing surface 101*a* covering the throttle flow passage F22, and an engagement portion 102 engaged with a pressing elastic member SP3.

The engagement portion 102 has a smaller diameter than that of the sealing portion 101, and a coil-shaped pressing elastic member SP3 is fitted into the engagement portion 102. As a result, a movement in the radial direction of the pressing elastic member SP3 is restricted by the engagement portion 102. One end of the pressing elastic member SP3 is supported by a lower end face of the sealing portion 101, and the other end of the pressing elastic member SP3 is supported by the coupling member 31. The pressing elastic member SP3 is elastically deformed in the axis line direction to impart an elastic force to the moving member 100, and the sealing surface 101*a* of the moving member 100 is resiliently pressed against a lower end face of the orifice member 32 and come in close contact with each other.

Figure 4:
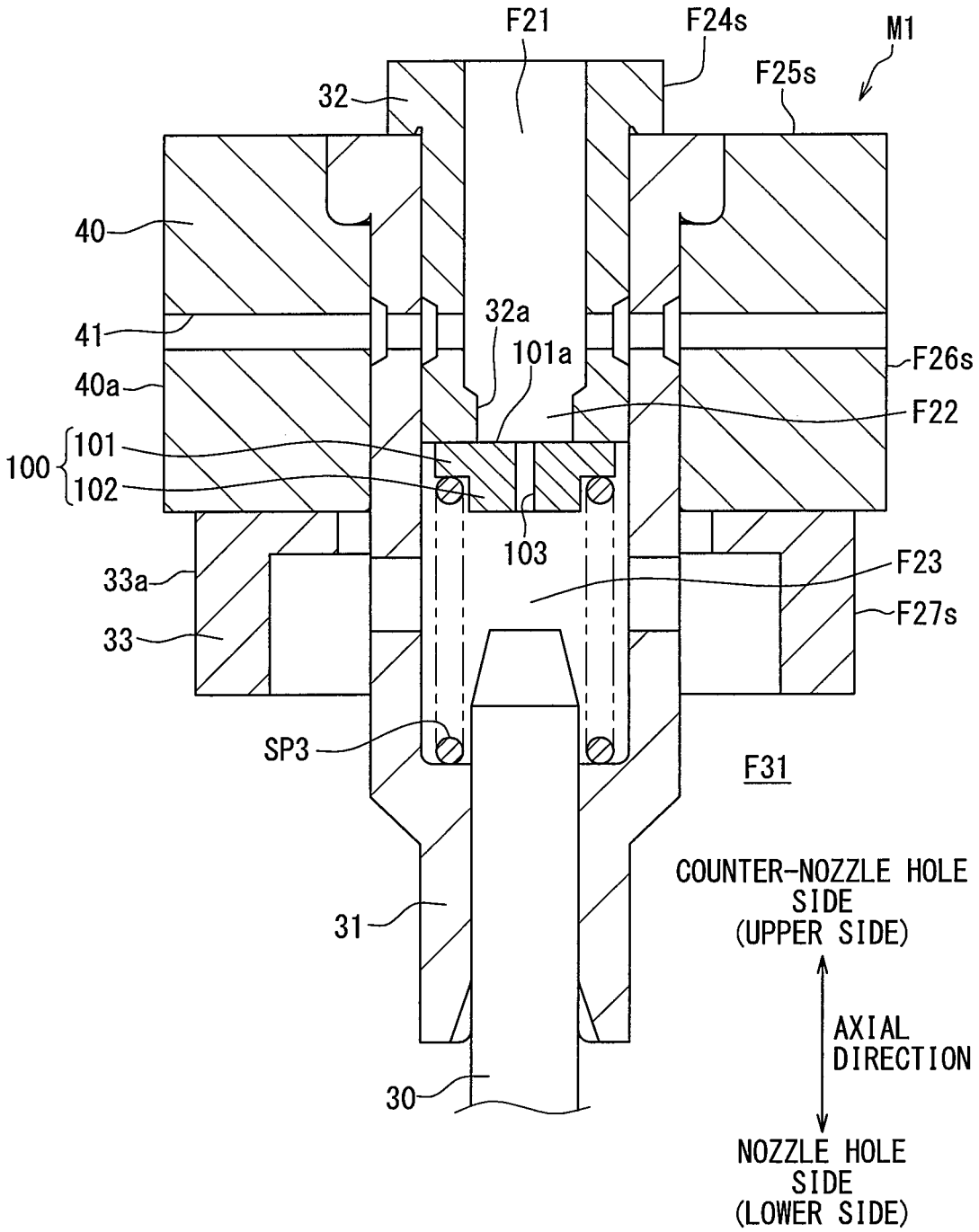
FIG. 4 is a cross-sectional view of a fuel injection valve according to a second embodiment of the present disclosure, showing a state in which a moving member is seated on a fixed member.
Figure 5:
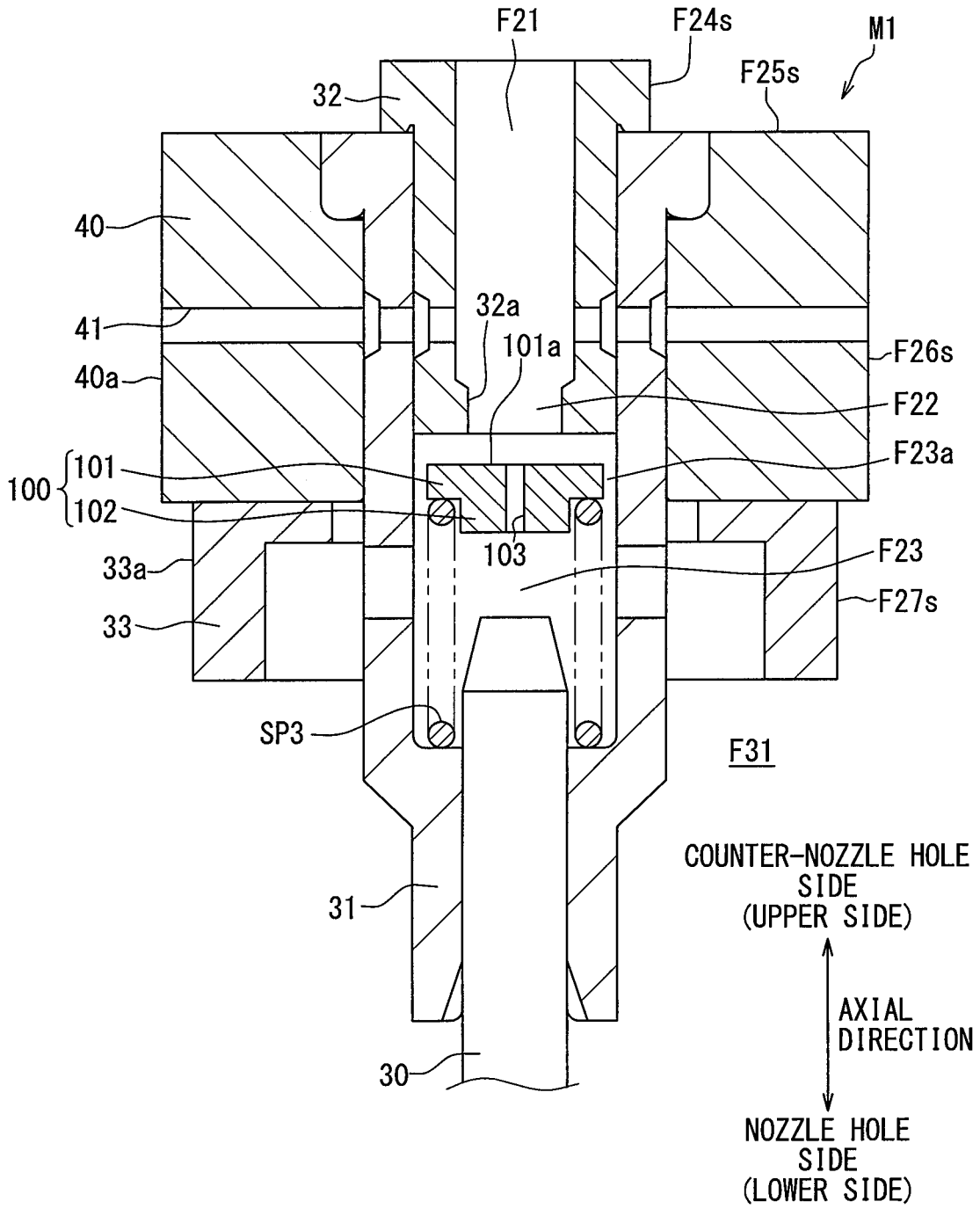
FIG. 5 is a cross-sectional view of the fuel injection valve according to the second embodiment, showing a state in which the moving member is unseated from the fixed member.

When an upstream side fuel pressure of the moving member 100 becomes higher than a downstream side fuel pressure by a predetermined amount or more as the valve body 30 moves toward the valve opening direction, the moving member 100 is separated from the orifice member 32 against an elastic force of the pressing elastic member SP3 (refer to FIG. 5). When the downstream side fuel pressure of the moving member 100 becomes higher than the upstream side fuel pressure by a predetermined amount or more as the valve body 30 moves in the valve closing direction, the moving member 100 is seated on the orifice member 32 (refer to FIG. 4).

When the moving member 100 is unseated, a flow passage (outer peripheral flow passage F23*a*) through which the fuel flows is provided in a gap between the outer peripheral surface of the moving member 100 and the inner peripheral surface of the coupling member 31. When the outer peripheral flow passage F23*a* and the sub-throttle flow passage 103 are positioned in parallel and the moving member 100 is unseated, the fuel flowing out from the throttle flow passage F22 to the flow passage F23 branches and flows into the sub-throttle flow passage 103 and the outer peripheral flow passage F23*a*. The passage area obtained by combining the sub-throttle flow passage 103 and the outer peripheral flow passage F23*a* is larger than the passage area of the throttle flow passage F22. Therefore, in a state in which the moving member 100 is unseated, a flow rate of the movable flow passage F20 is specified by the degree of throttling in the throttle flow passage F22.

On the other hand, when the moving member 100 is seated, the fuel flowing out from the throttle flow passage F22 to the flow passage F23 flows through the sub-throttle flow passage 103, and the fuel does not flow into the outer peripheral flow passage F23*a*. The passage area of the sub-throttle flow passage 103 is smaller than the passage area of the throttle flow passage F22. Therefore, in a state in which the moving member 100 is seated, the flow rate of the movable flow passage F20 is specified by the degree of throttling in the sub-throttle flow passage 103. Therefore, the moving member 100 is seated on the orifice member 32 to cover the throttle flow passage F22 to increase the degree of throttling, and is unseated from the orifice member 32 to open the throttle flow passage F22 to decrease the degree of throttling.

If the valve body 30 is moving in the valve opening direction, there is a high probability that the upstream side fuel pressure of the moving member 100 is higher than the downstream side fuel pressure by a predetermined value or more and the moving member 100 is unseated. However, if the valve body 30 is in the full lift state in which the valve body 30 is moved most in the valve opening direction and the valve body 30 stops moving, there is a high probability that the moving member 100 is seated.

If the valve body 30 is moving in the valve closing direction, there is a high probability that the downstream side fuel pressure of the moving member 100 becomes higher than the upstream side fuel pressure by a predetermined value or more, and the moving member 100 is seated. However, in some cases, when a valve opening period is shortened to reduce the injection amount from the nozzle hole 23*a*, the injection (partial lift injection) in which the valve body 30 is switched from the valve opening operation to the valve closing operation without moving to the full lift position is performed. In that case, there is a high probability that the moving member 100 is unseated immediately after switching to the valve closing operation. However, in a period immediately before the valve closing operation thereafter, there is a high probability that the downstream side fuel pressure of the moving member 100 becomes higher than the upstream side fuel pressure by a predetermined value or more, and the moving member 100 is seated.

In short, the moving member 100 is not always opened during the valve opening operation of the valve body 30, and the moving member 100 is seated at least in a period immediately after the valve opening operation in an ascending period in which the valve body 30 moves in the valve opening direction. In addition, the moving member 100 is not always seated during the valve closing operation of the valve body 30, and the moving member 100 is seated at least in a period immediately before the valve closing operation in a descending period in which the valve body 30 moves in the valve closing direction. Therefore, in the period immediately after the valve is opened and the period immediately before the valve is closed, the moving member 100 is seated and the entire amount of fuel flows through the sub-throttle flow passage 103, so that the degree of throttling in the movable flow passage F20 becomes larger than that in the period during which the moving member 100 is unseated.

As described above, according to the present embodiment, the movable structure M1 has the variable throttle mechanism for changing the degree of throttling of the flow rate in the flow passage F. For that reason, the braking force by the fuel acting on the movable structure M1 can be changed.

Further, according to the present embodiment, the degree of throttling by the variable throttle mechanism becomes larger than that in the full lift state in at least a period immediately before the valve closing operation in the valve closing operation period in which the valve body 30 moves in the valve closing direction. For that reason, in the period immediately before the closing of the valve, since the pressure difference between the two regions increases due to the increase in the degree of throttling, the braking force increases and a valve closing operation speed of the valve body 30 decreases, thereby being capable of reducing the possibility that the valve body 30 bounces on the seating surface 23*s*. On the other hand, in the full lift valve opening period, the degree of throttling becomes small, so that a pressure loss in an injection period can be reduced.

Further, according to the present embodiment, the degree of throttling by the variable throttle mechanism becomes larger than that in the full lift state in at least a period immediately after the valve opening operation in the valve opening operation period in which the valve body 30 moves in the valve opening direction. For that reason, in the period immediately after the valve opening operation, since the pressure difference between the two regions increases due to the increase in the degree of throttling, the braking force increases and the valve opening speed of the valve body decreases. Therefore, in the partial lift injection described above, the injection amount from the nozzle hole 23*a* with respect to an energization period of the coil 70 can be reduced. For that reason, the variation in the characteristics of the injection amount with respect to the energization period can be reduced.

Further, in the present embodiment, the variable throttle mechanism includes the orifice member 32 (fixed member) in which the orifice 32*a* (throttle portion) is formed, and the moving member 100 that moves relative to the orifice member 32. The moving member 100 is seated on the orifice member 32 to cover the throttle flow passage F22 to increase the degree of throttling, and is unseated from the orifice member 32 to open the throttle flow passage F22 to decrease the degree of throttling. For that reason, since the degree of throttling can be made variable by unseating and seating the moving member 100, the variable throttle mechanism can be realized with a simple structure.

Further, in the present embodiment, the moving member 100 is located on the downstream side of the orifice member 32. As the valve body 30 moves in the valve opening direction, the upstream side fuel pressure of the moving member 100 becomes higher than the downstream side fuel pressure by a predetermined value or more, as a result of which the moving member 100 is unseated from the seat. Further, as the valve body 30 moves in the valve closing direction, the downstream side fuel pressure becomes higher than the upstream side fuel pressure by a predetermined value or more, so that the moving member is seated. According to the above configuration, an actuator for moving the moving member 100 is unnecessary, and the moving member 100 is moved to vary the degree of throttling.

Further, according to the present embodiment, the moving member 100 is provided with the sub-throttle flow passage 103 which is a part of the flow passage F, and the passage area of the sub-throttle flow passage 103 is smaller than the passage area of the throttle flow passage F22. Contrary to the present embodiment, in the case where the sub-throttle flow passage 103 is not provided, there is a possibility that the moving member 100 is attached to the orifice member 32 and less likely to be peeled off, and the moving member 100 is less likely to be unseated. On the other hand, in the present embodiment, since the sub-throttle flow passage 103 is provided in the moving member 100, the possibility of sticking can be reduced.

Since pulsation occurs in the downstream fuel pressure PL immediately after the valve body 30 is seated on the seating surface 23*s* and closed, if the sub-throttle flow passage 103 is not provided contrary to the present embodiment, there is a risk that a rattling occurs in which the moving member 100 is repeatedly seated and unseated in accordance with the pulsation. On the other hand, according to the present embodiment, since the sub-throttle flow passage 103 is provided in the moving member 100, the possibility of the above-mentioned rattling can be reduced.

Third Embodiment

Figure 6:
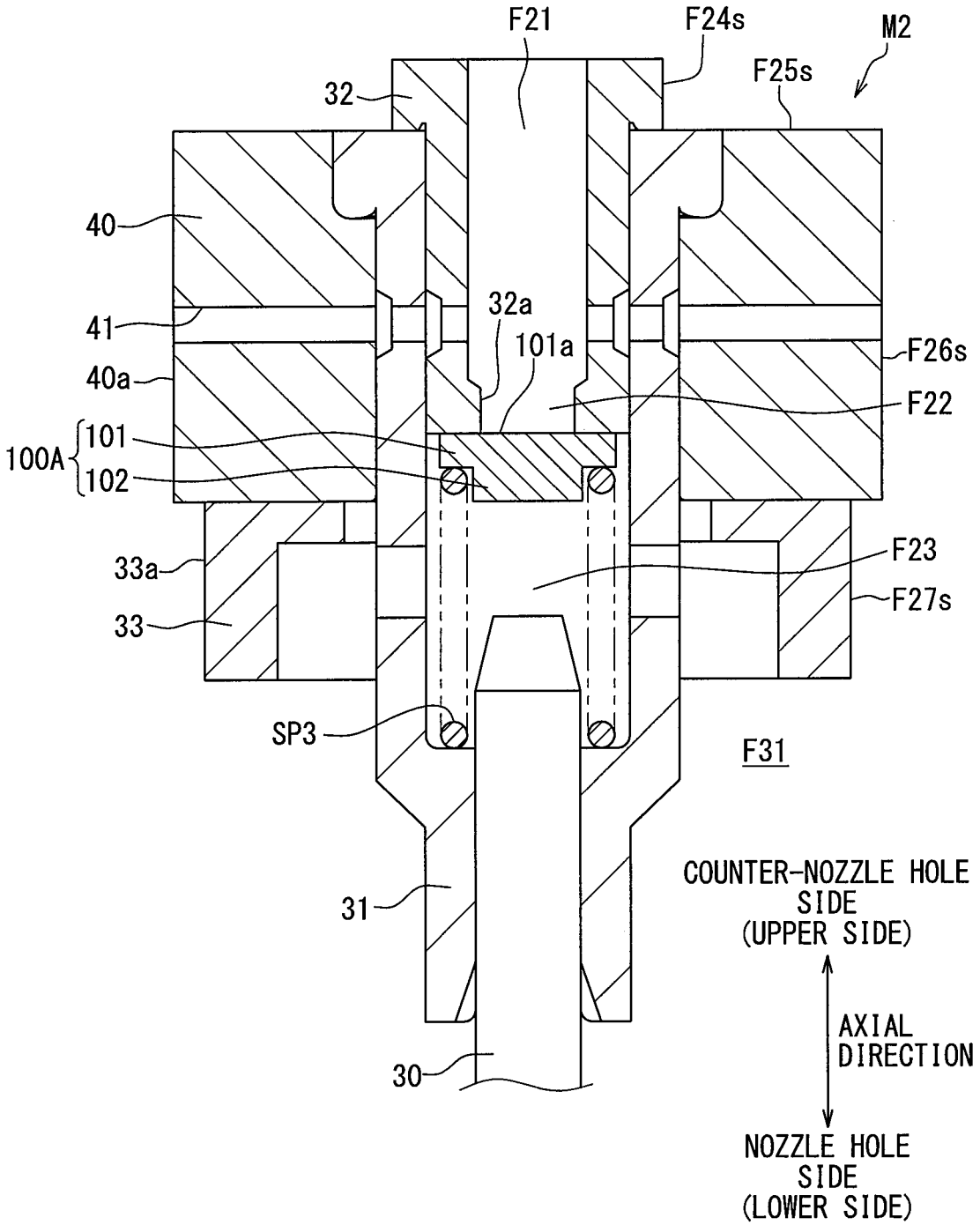
FIG. 6 is a cross-sectional view of a fuel injection valve according to a third embodiment of the present disclosure.

While the sub-throttle flow passage 103 is provided in the moving member 100 of the movable structure M1 according to the second embodiment, no sub-throttle flow passage 103 is provided in the moving member 100A of a movable structure M2 according to the present embodiment, as shown in FIG. 6.

Therefore, when the moving member 100A is unseated, the entire amount of a fuel flowing out from the throttle flow passage F22 to the flow passage F23 flows through the outer peripheral flow passage F23*a*. A passage area of the outer peripheral flow passage F23*a* is larger than a passage area of the throttle flow passage F22. Therefore, in a state in which the moving member 100A is unseated, a flow rate of the movable flow passage F20 is specified by the degree of throttling in the throttle flow passage F22.

On the other hand, in a state in which the moving member 100A is seated, the moving member 100A closes the throttle flow passage F22, and the fuel does not flow from the throttle flow passage F22 to the flow passage F23 inside the coupling member 31. Therefore, in a state in which the moving member 100A is seated, the flow rate of the movable flow passage F20 becomes zero, and the degree of throttling is maximum. Therefore, the moving member 100A is seated on the orifice member 32, thereby blocking the throttle flow passage F22 and stopping a flow of the movable flow passage F20, so that the degree of throttling is maximized. On the other hand, the moving member 100A opens the throttle flow passage F22 by being unseated from the orifice member 32, so that the fuel flows through the movable flow passage F20, and the degree of throttling is reduced from a maximum state.

As described above, according to the present embodiment, since the moving member 100A closes the throttle flow passage F22 in the state of being seated on the orifice member 32, a downstream fuel pressure PL at the time of seating the moving member 100A can be increased. Therefore, a pressure difference ΔP between an upstream region and a downstream region with the orifice 32*a* as a boundary can be increased. For that reason, the braking force in the seated state of the moving member 100A is larger than that in the case where the sub-throttle flow passage 103 is provided in the moving member 100. Therefore, a reduction in the valve closing operation speed of the valve body 30 can be reduced, and the effect of reducing the bounce of the valve body 30 can be improved.

Fourth Embodiment

Figure 7:
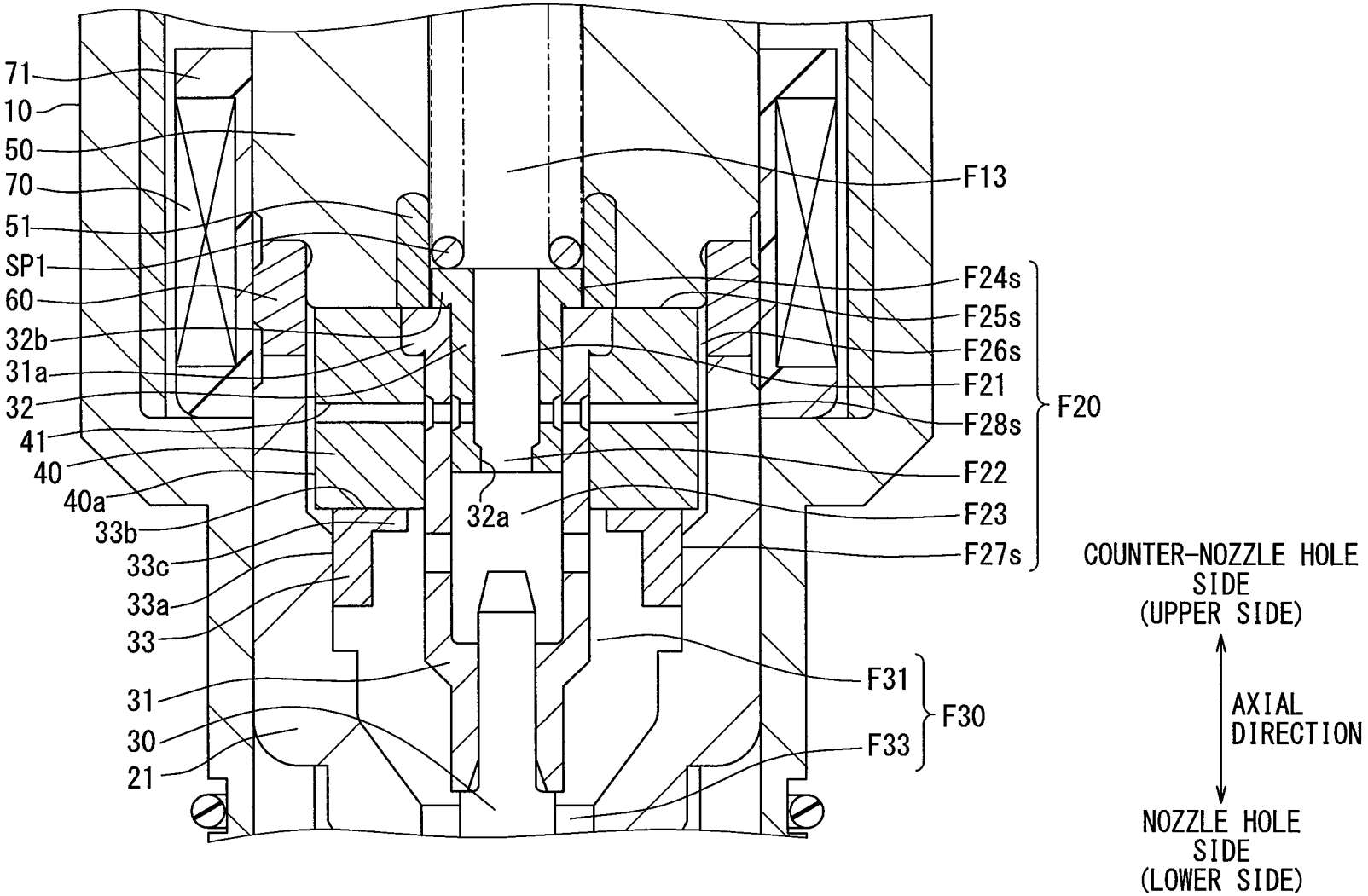
FIG. 7 is a cross-sectional view of a fuel injection valve according to a fourth embodiment of the present disclosure.

In the first embodiment, the sliding member 33 is separate from the moving core 40, and is located in a state of being able to move relative to the moving core 40 in the radial direction. In contrast, in the present embodiment shown in FIG. 7, the sliding member 33 is joined to a moving core 40 by welding or the like. Accordingly, in the present embodiment, a close contact elastic member SP2 and the support member 24 are eliminated.

When the sliding member 33 is made separate from the moving core 40 and movable in the radial direction as in the first embodiment, a counter-nozzle hole side guide portion is provided in a portion of the movable structure M excluding the sliding member 33. On the other hand, in the present embodiment in which the sliding member 33 is joined to the moving core 40, a counter-nozzle hole side guide portion is provided on the sliding member 33. In other words, the sliding surface 33*a* of the sliding member 33 functions as an counter-nozzle hole side guide portion.

Fifth Embodiment

Figure 8:
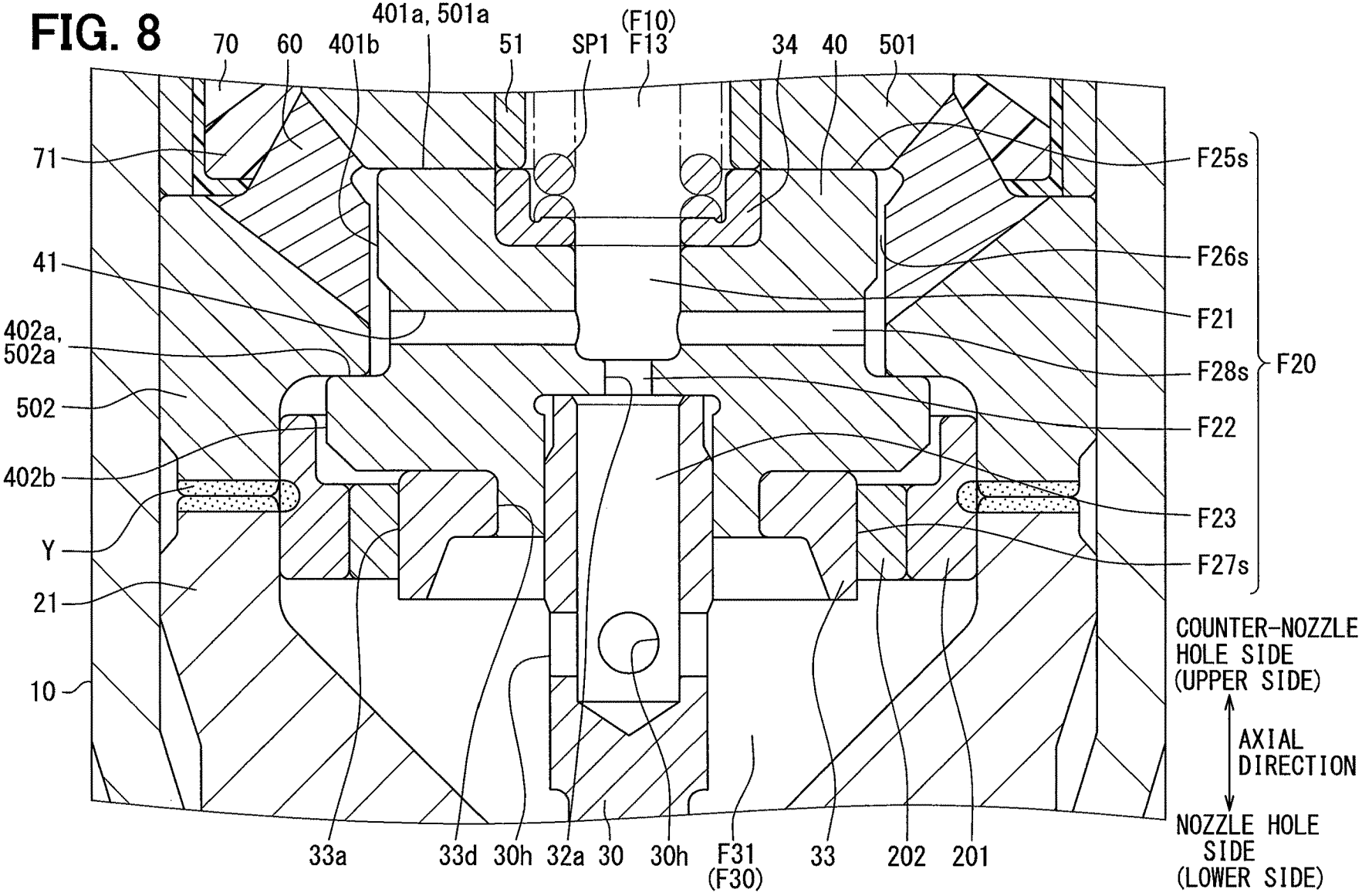
FIG. 8 is a cross-sectional view of a fuel injection valve according to a fifth embodiment of the present disclosure.

In the first embodiment, the orifice 32*a* is provided in the orifice member 32, and the orifice member 32 is assembled to the moving core 40. In contrast, according to the present embodiment, the orifice member 32 is eliminated, and the orifice 32*a* is provided directly in a moving core 40 as shown in FIG. 8.

According to the first embodiment, the flow passage F28*s* provided by the through-hole 41 is formed by three components of the moving core 40, the coupling member 31, and the orifice member 32, whereas in the present embodiment, the through hole 41 is provided by one component of the moving core 40. The through hole 41 communicates with the flow passage F21 located on an inner diameter side of the moving core 40 and a flow passage F26*s* located on an outer shape side of the moving core 40.

Among center holes extending in an axis line direction at the center of the moving core 40, the flow passage F21 which is a portion communicating with the orifice 32*a* on a counter-nozzle hole side corresponds to a communication flow passage communicating with the throttle flow passage F22 and the through hole 41. A passage area of the throttle flow passage F22 is smaller than a passage area of the communication flow passage. A passage area of a sliding flow passage F27*s* is smaller than a passage area of the throttle flow passage F22. The passage area in the present disclosure refers to an area of a cross section obtained by cutting a corresponding passage in a direction orthogonal to a fuel flow direction.

The moving core 40 according to the first embodiment has an attracted surface to be sucked by an attracting surface of a stationary core 50, and the attracted surface is one surface extending perpendicularly to the axis line direction. On the other hand, the moving core 40 according to the present embodiment has two attracted surfaces, that is, a first attracted surface 401*a* and a second attracted surface 402*a*. The first attracted surface 401*a* is located to face a first attracting surface 501*a* formed by a first stationary core 501, and is attracted by a magnetic flux passing through an air gap with the first attracting surface 501*a*. The second attracted surface 402*a* is located to face the second attracting surface 502*a* formed by a second stationary core portion 502, and is attracted by a magnetic flux passing through an air gap with the second attracting surface 502*a*.

The first attracted surface 401*a* and the second attracted surface 402*a* are placed at different positions from each other in the radial direction, and are also placed at different positions from each other in the axis line direction. Specifically, the first attracted surface 401*a* is located on radially inner side of the second attracted surface 402*a* and located on the counter-nozzle hole side in the axis line direction. In short, the moving core 40 according to the present embodiment is formed in a stepped shape having two attracted surfaces placed at different positions in the radial direction and the axis line direction.

A portion of an outer peripheral surface of the moving core 40 which continues to the first attracted surface 401*a* is referred to as a first outer peripheral surface 401*b*, and a portion of the outer peripheral surface of the moving core 40 which continues to the second attracted surface 402*a* is referred to as a second outer peripheral surface 402*b*. The first outer peripheral surface 401*b* is located on the radially inner side of the second outer peripheral surface 402*b*. One end of the through hole 41 is located on the first outer peripheral surface 401*b*.

The non-magnetic member 60 is located between the first stationary core 501 and the second stationary core portion 502. For that reason, an orientation of a magnetic flux passing through the first attracted surface 401*a* and the first attracting surface 501*a* and an orientation of a magnetic flux passing through the second attracted surface 402*a* and the second attracting surface 502*a* are opposite to each other.

An end face of the second stationary core portion 502 and an end surface of the main body portion 21 are fixed to each other by welding. A dotted portion in FIG. 8 indicates a portion (welded portion Y) melted and solidified by welding. A cylindrical welding cover 201 is fixed to inner peripheral surfaces of the second stationary core portion 502 and the main body portion 21. The welding cover 201 is welded by the welded portion Y. A sliding member 202 is fixed to an inner peripheral surface of the welding cover 201 by fitting. An inner peripheral surface of the sliding member 202 supports an outer peripheral surface (sliding surface 33*a*) of the sliding member 33 in the radial direction in a slidable state. An inner peripheral surface of the sliding member 33 functions as a fitting surface 33*d* to be fitted to the moving core 40.

The welding cover 201, the sliding member 202, the sliding member 33, and the moving core 40 are made of different materials. Specifically, the moving core 40 is made of a high magnetic material, the sliding member 33 and the sliding member 202 area made of a material having a high hardness excellent in abrasion resistance, and the welding cover 201 is made of a material favorable for welding.

With the elimination of the orifice member 32 as described above, the valve body 30 is directly attached to the moving core 40. Specifically, an end portion of the valve body 30 on the counter-nozzle hole side is fixed to a recess portion provided on a surface (lower end face) of the moving core 40 on the nozzle hole side by fitting. The flow passage F23 is provided inside the end portion of the valve body 30 on the counter-nozzle hole side. The flow passage F23 inside the valve body 30 communicates with the flow passage F31, which is the downstream passage F30, through a passage hole 30*h* provided in the valve body 30.

An abutment member 34 is fixedly fitted to a recess portion provided on a surface of the moving core 40 on the counter-nozzle hole side (upper end face). When the valve body 30 is opened and reaches a full lift position, the abutment member 34 abuts against the stopper 51 to prevent the moving core 40 from abutting against the stationary core 50. The abutment member 34 also functions as a member for supporting an elastic member SP1.

In this example, contrary to the present embodiment, for example, in the case where the orifice member 32 having the orifice 32*a* is fixedly press-fitted to the moving core 40, the orifice 32*a* may be deformed by the press-fitting, and a passage area of the throttle flow passage F22 may change from a desired value. When the orifice 32*a* is deformed in this manner, a braking force caused by the pressure difference ΔP between the upstream fuel pressure PH and the downstream fuel pressure PL described above deviates from a desired value. To cope with the above matter, according to the present embodiment, the throttle flow passage F22 provided by the orifice 32*a* is provided in the moving core 40. For that reason, since the deformation of the orifice 32*a* due to the press-fit deformation can be avoided, the deviation of the braking force due to the pressure difference ΔP can be reduced.

In this example, contrary to the present embodiment, for example, when the flow passage F28*s* provided by the through hole 41 is provided by three components of the moving core 40, the coupling member 31, and the orifice member 32, there is a possibility that the fuel in the through hole 41 leaks from the abutment surfaces of the respective members. When such leakage occurs, the braking force due to the pressure difference ΔP deviates from the desired value. To cope with the above matter, according to the present embodiment, the throttle flow passage F22 and the flow passage F21 (communication flow passage) are provided in the moving core 40, and the communication flow passage is located on the counter-nozzle hole side of the throttle flow passage F22 and communicates with the throttle flow passage F22 and the through hole 41. For that reason, since the through hole 41 (flow passage F28*s*) is provided by one part of the moving cores 40, the leakage of fuel from the through hole 41 communicating with the communicating flow passage can be avoided, and the deviation of the braking force due to the pressure difference ΔP can be reduced.

Sixth Embodiment

Figure 9:
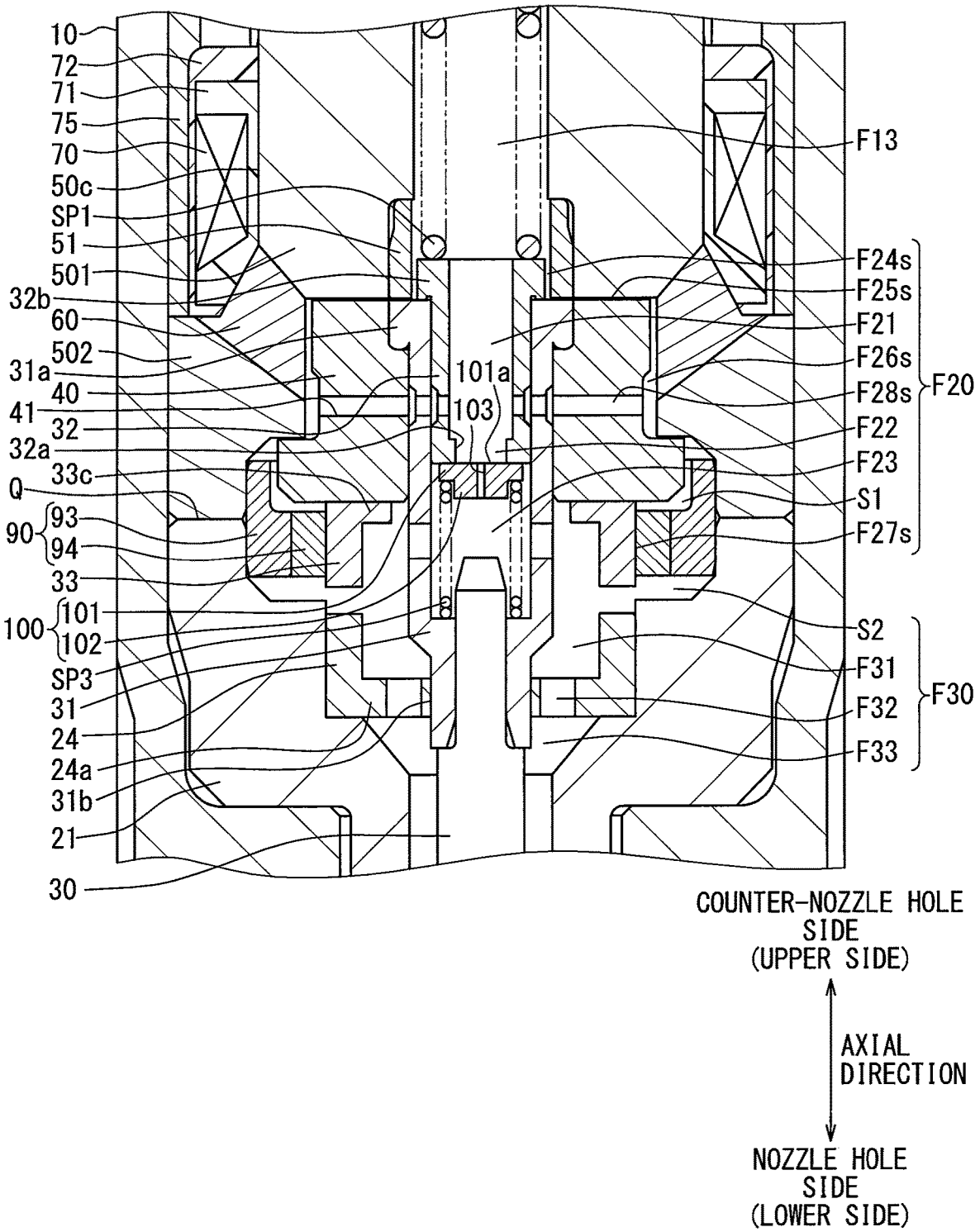
FIG. 9 is an enlarged view of a periphery of a moving core according to a sixth embodiment of the present disclosure.
Figure 10:
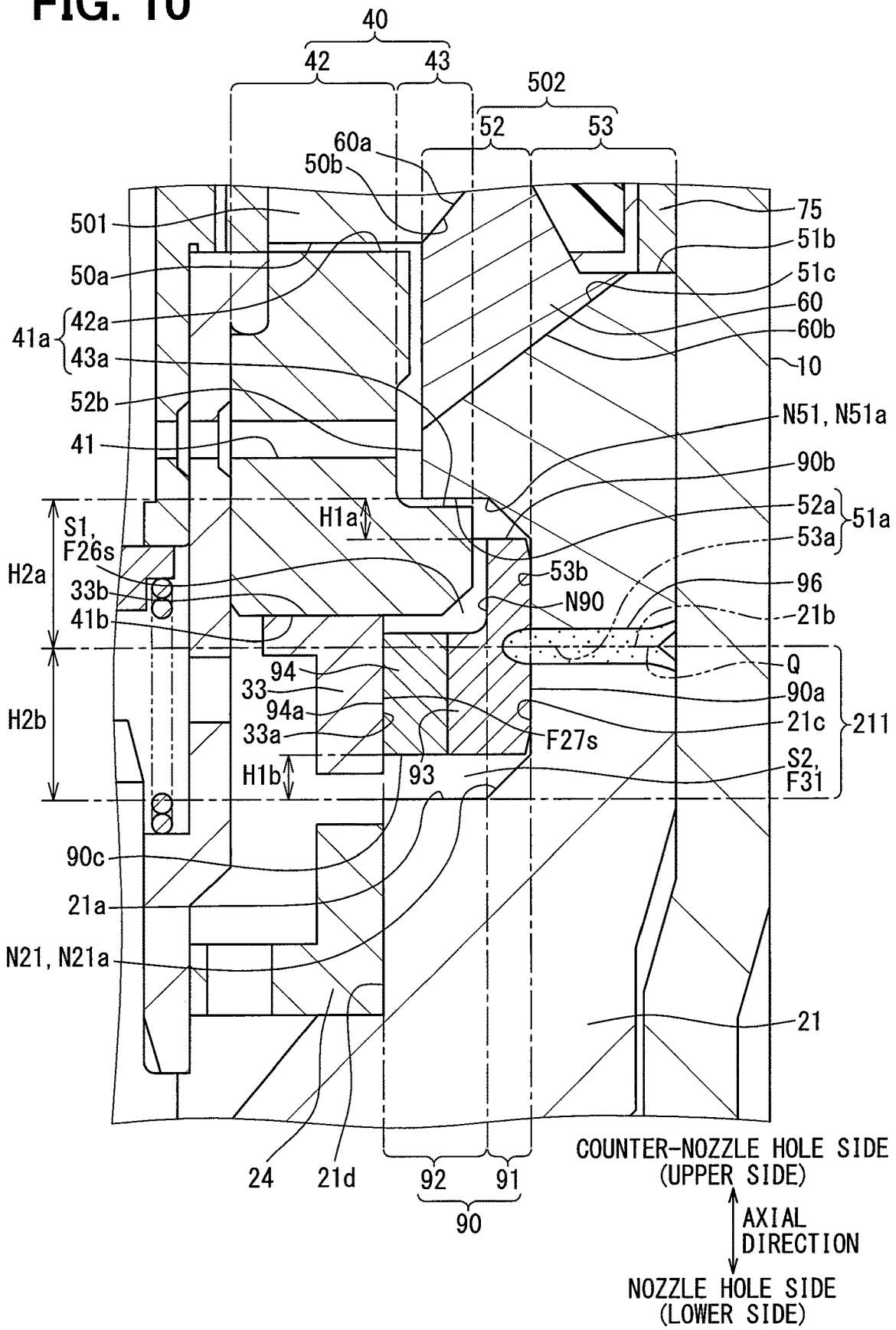
FIG. 10 is an enlarged view of a periphery of a cover body of FIG. 9.

As shown in FIGS. 9 and 10, a moving core 40 is a toric member made of metal. The moving core 40 has a movable inner portion 42 and a movable outer portion 43, both of which are toric. The movable inner portion 42 forms an inner peripheral surface of the moving core 40, and the movable outer portion 43 is located on the radially outer side of the movable inner portion 42. The moving core 40 has a movable upper surface 41*a* facing the counter-nozzle hole side, and the movable upper surface 41*a* forms an upper end face of the moving core 40. A step is formed on the movable upper surface 41*a*. Specifically, the movable outer portion 43 has a movable outer upper surface 43*a* facing the counter-nozzle hole side, the movable inner portion 42 has a movable inner upper surface 42*a* facing the counter-nozzle hole side, and the movable outer upper surface 43*a* is located on the nozzle hole side with respect to the movable inner upper surface 42*a*, so that a step is formed on the movable upper surface 41*a*. The movable inner upper surface 42*a* and the movable outer upper surface 43*a* are both perpendicular to the axis line direction.

The moving core 40 has a movable lower surface 41*b* facing the nozzle hole side, and the movable lower surface 41*b* forms a flat lower end face in the moving core 40 in a state of extending across the movable inner portion 42 and the movable outer portion 43 in the radial direction. In the movable lower surface 41*b*, a step is not formed at the boundary portion between the movable inner portion 42 and the movable outer portion 43. In the axis line direction, a height dimension of the movable outer portion 43 is smaller than a height dimension of the movable inner portion 42, and the moving core 40 is shaped such that the movable outer portion 43 protrudes from the movable inner portion 42 to the outer peripheral side. The sliding member 33 is fixed to the moving core 40 by welding or the like.

The stationary core 50 is fixedly located inside the case 10. The stationary core 50 is made of an annular metal extending around the axis line direction. The stationary core 50 includes the first stationary core 501 and a second stationary core 502. The first stationary core 501 is provided on an inner peripheral side of the coil 70, and an outer peripheral surface of the first stationary core 501 and the inner peripheral surface of the coil 70 face each other. The first stationary core 501 has a first lower surface 50*a* facing the nozzle hole side, and the first lower surface 50*a* forms a lower end face of the first stationary core 501 and is orthogonal to the axis line direction. The first stationary core 501 is provided on the counter-nozzle hole side of the moving core 40, and the first lower surface 50*a* faces the movable inner upper surface 42*a* of the moving core 40. The first stationary core 501 has a first inclined surface 50*b* and a first outer surface 50*c*. The first inclined surface 50*b* extends obliquely from an outer peripheral side end portion of the first lower surface 50*a* toward the counter-nozzle hole side. The first outer surface 50*c* is an outer peripheral surface of the first stationary core 501, and extends in the axis line direction from an upper end portion of the first inclined surface 50*b* on the counter-nozzle hole side. The first stationary core 501 is shaped such that an outgoing corner portion of the first lower surface 50*a* and the first outer surface 50*c* is chamfered by the first inclined surface 50*b*.

The second stationary core 502 is provided on the nozzle hole side of the coil 70, and has a toric shape as a whole. The second stationary core 502 has a second inner portion 52 and a second outer portion 53, both of which are toric. The second outer portion 53 forms an outer peripheral surface of the second stationary core 502, and the second inner portion 52 is located on an inner peripheral side of the second outer portion 53. The second stationary core 502 has a second lower surface 51*a* facing the nozzle hole side, and the second lower surface 51*a* forms a lower end face of the second stationary core 502 and is orthogonal to the axis line direction. A step is formed on the second lower surface 51*a*. Specifically, the second inner portion 52 has a second inner lower surface 52*a* facing the nozzle hole side, the second outer portion 53 has a second outer lower surface 53*a* facing the nozzle hole side, and the second inner lower surface 52*a* is located on the counter-nozzle hole side of the second outer lower surface 53*a*, so that a step is formed on the second lower surface 51*a*. In the axis line direction, a height dimension of the second inner portion 52 is smaller than a height dimension of the second outer portion 53, and the second stationary core 502 is shaped such that the second inner portion 52 protrudes from the second outer portion 53 toward the inner peripheral side.

The second inner portion 52 of the second stationary core 502 is located on the counter-nozzle hole side of the movable outer portion 43 of the moving core 40, and the second inner portion 52 and the movable outer portion 43 are aligned in the axis line direction. In that case, the second inner lower surface 52*a* and the movable outer upper surface 43*a* face each other in the axis line direction.

In the second stationary core 502, the second outer portion 53 is provided on the counter-nozzle hole side of the main body portion 21. In this example, the main body portion 21 has an outer extending portion 211 extending from an end portion in the radially outer side toward the counter-nozzle hole side. The outer extending portion 211 is spaced apart from an end portion on the radially inner side in an upper end surface of the main body portion 21, thereby forming a step on the upper end face of the main body portion 21. The main body portion 21 includes a main body inside upper surface 21*a*, a main body outside upper surface 21*b*, a main body outside inner surface 21*c*, and a main body inside inner surface 21*d*. The main body inside upper surface 21*a* and the main body outside upper surface 21*b* face the counter-nozzle hole side, and the main body outside inner surface 21*c* and the main body inside inner surface 21*d* face radially inward. The main body outside upper surface 21*b* is an upper end face of the outer extending portion 211, and the main body outside inner surface 21*c* is an inner peripheral surface of the outer extending portion 211. The main body inside inner surface 21*d* extends from an end portion on the radially inner side of the main body inside upper surface 21*a* toward the nozzle hole side and is an inner peripheral surface of the main body portion 21. The main body inside upper surface 21*a* is a portion of the upper end face of the main body portion 21 which is radially inner side of the main body outside inner surface 21*c*. The main body inside upper surface 21*a* and the main body outside upper surface 21*b* are orthogonal to each other in the axis line direction, and the main body outside inner surface 21*c* extends parallel to the axis line direction.

In the second stationary core 502, the second outer lower surface 53*a* is superposed on the main body outside upper surface 21*b*, and the second stationary core 502 and the main body portion 21 are joined to each other by welding such as laser welding at the superposed portion. In a state before welding is performed, the second outer lower surface 53*a* and the main body outside upper surface 21*b* are included in a fixed boundary portion Q which is a boundary portion between the second stationary core 502 and the main body portion 21. In the radial direction, a width dimension of the second outer lower surface 53*a* and a width dimension of the main body outside upper surface 21*b* are the same, and the second outer lower surface 53*a* and the main body outside upper surface 21*b* entirely overlap with each other. The outer peripheral surface of the second outer portion 53 and the outer peripheral surface of the main body portion 21 respectively overlap with the inner peripheral surface of the case 10.

The second stationary core 502 has a second upper surface 51*b* and a second inclined surface 51*c*. The second inclined surface 51*c* extends diagonally from a second inside inner surface 52*b*, which is an inner peripheral surface of the second inner portion 52, toward the counter-nozzle hole side, and the second upper surface 51*b* extends radially from an upper end portion of the second inclined surface 51*c*. In that case, the second upper surface 51*b* and the second inclined surface 51*c* form an upper end face of the second stationary core 502. The second inclined surface 51*c* extends across the second inner portion 52 and the second outer portion 53 in the radial direction. The second stationary core 502 is shaped such that the second inclined surface 51*c* and the outer peripheral surface are chamfered by the second upper surface 51*b*.

The non-magnetic member 60 is formed of an annular metal member extending around the axis line direction, and is provided between the first stationary core 501 and the second stationary core 502. The non-magnetic member 60 is lower in magnetism than the stationary core 50 and the moving core 40, and is made of, for example, a nonmagnetic material. Similar to the non-magnetic member 60, the main body portion 21 is also lower in magnetism than the stationary core 50 and the moving core 40, and is made of, for example, a nonmagnetic material. On the other hand, the stationary core 50 and the moving core 40 have magnetism, and are made of, for example, a ferromagnetic material.

The stationary core 50 and the moving core 40 may be referred to as a magnetic flux passage member that is likely to form a path of magnetic flux, and the non-magnetic member 60 and the main body portion 21 may be referred to as a magnetic flux regulation member that is less likely to form a path of magnetic flux. In particular, the non-magnetic member 60 has a function of restricting the magnetic flux from passing through the stationary core 50 without passing through the moving core 40 by being magnetically short-circuited, and the non-magnetic member 60 can also be referred to as a short-circuit regulation member. In addition, the non-magnetic member 60 constitutes a short-circuit regulation portion. With respect to the nozzle body 20, since the main body portion 21 and the nozzle portion 22 are integrally molded of a metal material, both of the main body portion 21 and the nozzle portion 22 are lowered in magnetism.

The non-magnetic member 60 has an upper inclined surface 60*a* and a lower inclined surface 60*b*. The upper inclined surface 60*a* is superimposed on the first inclined surface 50*b* of the first stationary core 501, and the upper inclined surface 60*a* and the first inclined surface 50*b* are joined to each other by welding. The lower inclined surface 60*b* is superimposed on the second inclined surface 51*c* of the second stationary core 502, and the lower inclined surface 60*b* and the second inclined surface 51*c* are joined to each other by welding. At least a part of each of the first inclined surface 50*b* and the second inclined surface 51*c* is aligned in the axis line direction, and the non-magnetic member 60 enters between the inclined surfaces 50*b* and 51*c* at least in the axis line direction.

A cylindrical stopper 51 made of metal is fixed to an inner peripheral surface of the first stationary core 501. The stopper 51 is a member that restricts the movable structure M from moving to the counter-nozzle hole side by abutting against the coupling member 31 of the movable structure M, and the movement of the movable structure M is restricted by a lower end face of the stopper 51 abutting against an upper end face of the enlarged diameter portion 31*a* of the coupling member 31. The stopper 51 protrudes toward the nozzle hole side from the first stationary core 501. For that reason, even in a state in which the movement of the movable structure M is restricted by the stopper 51, a predetermined gap is defined between the stationary core 50 and the moving core 40. In that case, the gap is provided between the first lower surface 50*a* and the movable inner upper surface 42*a*, or between the second inner lower surface 52*a* and the movable outer upper surface 43*a*. In FIG. 10 and the like, in order to clearly illustrate those gaps, a separation distance between the first lower surface 50*a* and the movable inner upper surface 42*a* and a separation distance between the second inner lower surface 52*a* and the movable outer upper surface 43*a* are illustrated to be larger than actual.

The coil 70 is located the radially outer side of the non-magnetic member 60 and the stationary core 50. The coil 70 is wound around the bobbin 71 made of resin. The bobbin 71 has a cylindrical shape centered on the axis line direction. Therefore, the coil 70 is located in an annular shape extending around the axis line direction. The bobbin 71 is in contact with the first stationary core 501 and the non-magnetic member 60. An opening portion, an upper end face, and a lower end face on an outer peripheral side of the bobbin 71 are covered with a cover 72 made of resin.

A yoke 75 is provided between the cover 72 and the case 10. The yoke 75 is located on the counter-nozzle hole side of the second stationary core 502, and abuts on the second upper surface 51*b* of the second stationary core 502. The yoke 75 has magnetism like the stationary core 50 and the moving core 40, and is made of, for example, a ferromagnetic material. The stationary core 50 and the moving core 40 are located at positions in contact with the fuel, such as providing a flow passage, and have oil resistance. On the other hand, the yoke 75 is located at a position not in contact with the fuel, such as not providing a flow passage, and does not have oil resistance. For that reason, the yoke 75 has higher magnetism than the stationary core 50 and the moving core 40.

In the present embodiment, a cover body 90 covering the fixed boundary portion Q between the second stationary core 502 and the main body portion 21 is provided on the inner peripheral side of the second stationary core 502 and the main body portion 21. The cover body 90 is annular and covers the entire fixed boundary portion Q in the circumferential direction of the second stationary core 502. The cover body 90 protrudes radially inward from the second stationary core 502 and the main body portion 21 in a state of extending across the fixed boundary portion Q in the axis line direction. In this example, the main body portion 21 has a main body notch portion N21, the second stationary core 502 has a second notch portion N51, and the cover body 90 is in a state of being inserted into the notch portions N21 and N51.

In the main body portion 21, the main body notch portion N21 is formed by the main body outside inner surface 21*c* and the main body inside upper surface 21*a*. The main body notch portion N21 is opened to the nozzle hole side in the axis line direction and is opened to the radially inner side. The main body notch portion N21 has a notched inclined surface N21*a* connecting the main body outside inner surface 21*c* and the main body inside upper surface 21*a*, and is shaped such that a corner is chamfered by the notched inclined surface N21*a*.

In the second stationary core 502, the second notch portion N51 is formed by the second inner lower surface 52*a* and a second outside inner surface 53*b*. The second outside inner surface 53*b* extends in the axis line direction in a state of facing in a radially inward direction, and forms an inner peripheral surface of the second outer portion 53. The second notch portion N51 is formed by a step of the second lower surface 51*a* of the second stationary core 502, and is opened to the counter-nozzle hole side in the axis line direction, and is opened to the radially inner side. The second notch portion N51 has a notched inclined surface N51*a* connecting the second inner lower surface 52*a* and the second outside inner surface 53*b*, and is shaped such that a corner is chamfered by the notch inclined surface N51*a*.

The cover body 90 is located between the second inner lower surface 52*a* and the main body inside upper surface 21*a* in the notch portions N21 and N51. The main body outside inner surface 21*c* of the main body portion 21 and the second outside inner surface 53*b* of the second stationary core 502 are positioned on the same plane in the axis line direction. A cover outer surface 90*a*, which is an outer peripheral surface of the cover body 90, is superimposed on both of the main body outside inner surface 21*c* and the second outside inner surface 53*b* in a state in which the fixed boundary portion Q is covered from the inside. However, the cover outer surface 90*a* does not overlap with the notched inclined surfaces N21*a* and N51*a*.

Figure 11:
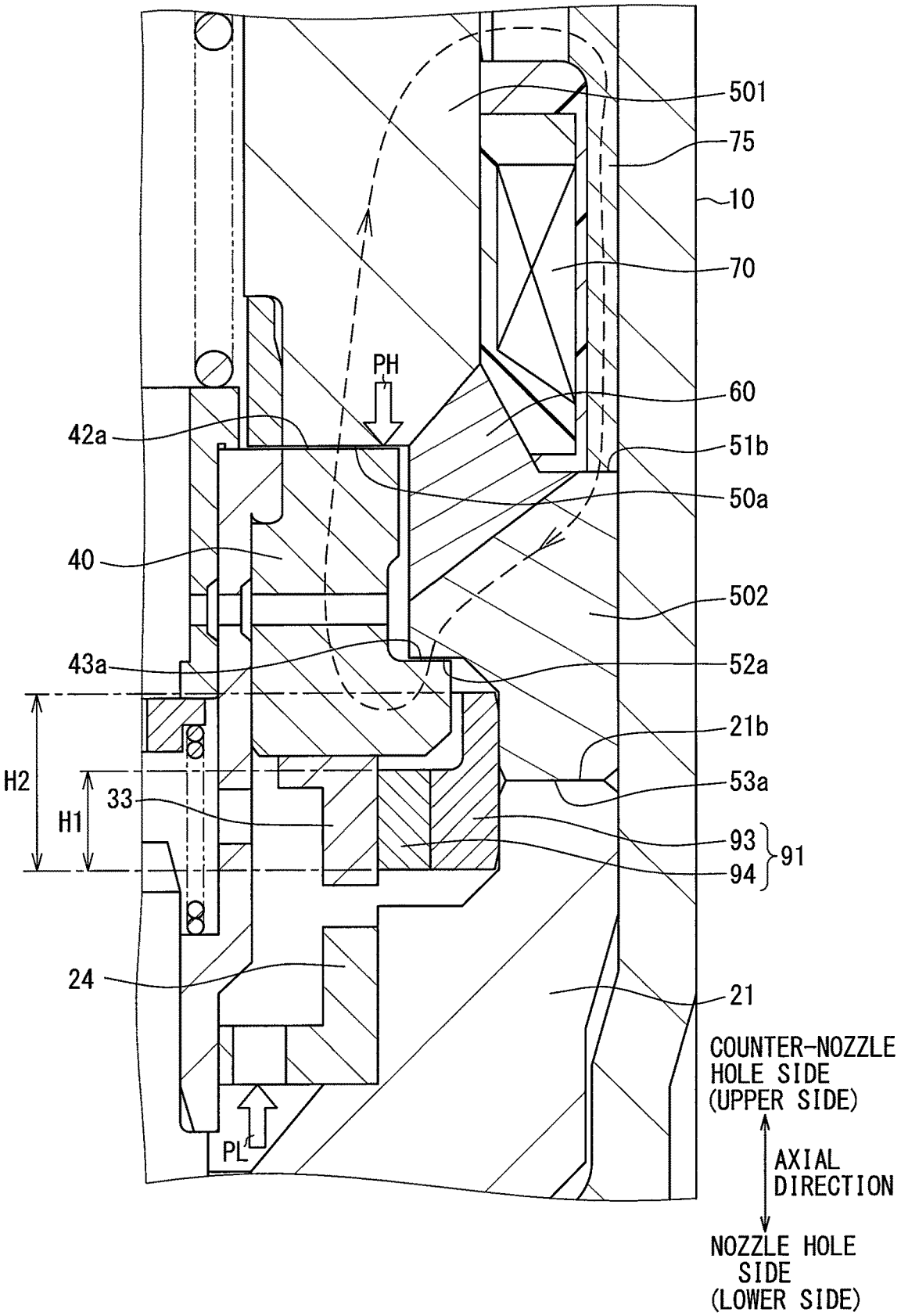
FIG. 11 is a diagram illustrating a path of a magnetic flux.

The cover body 90 has a cover inner portion 92 and a cover outer portion 91. The cover outer portion 91 forms the cover outer surface 90*a*, and the cover inner portion 92 is located on the radially inner side of the cover outer portion 91. A height dimension H1 of the cover inner portion 92 is smaller than a height dimension H2 of the cover outer portion 91 (refer to FIG. 11). The cover body 90 has a cover upper surface 90*b* facing the counter-nozzle hole side and a cover lower surface 90*c* facing the nozzle hole side. The cover upper surface 90*b* and the cover lower surface 90*c* have the same area.

On the cover upper surface 90*b*, an upper end face of the cover inner portion 92 on the counter-nozzle hole side is located on the nozzle hole side from the upper end surface of the cover outer portion 91 on the counter-nozzle hole side, thereby forming a step. The cover lower surface 90*c* forms a flat lower end face on the nozzle hole side of the cover body 90, and in the cover lower surface 90*c*, a step is not formed at a boundary portion between the cover inner portion 92 and the cover outer portion 91.

In the cover body 90, a cover notch portion N90 is formed by a step on the cover upper surface 90*b*. The cover notch portion N90 has an outgoing corner on the nozzle hole side and the outer peripheral side of the moving core 40. In that case, an end portion of the cover outer portion 91 on the counter-nozzle hole side is located between the movable outer portion 43 and the second outer portion 53 in the radial direction. The cover inner portion 92 is located on the nozzle hole side of the second outer portion 53 in the axis line direction.

In the cover body 90, the cover upper surface 90*b* is separated from the movable lower surface 41*b* of the moving core 40 and the second inner lower surface 52*a* of the second stationary core 502 to the nozzle hole side, and the cover lower surface 90*c* is separated from the main body inside upper surface 21*a* of the main body portion 21 to the counter-nozzle hole side. The cover outer portion 91 is inserted between the second outer portion 53 and the movable outer portion 43 in the radial direction, and the cover inner portion 92 is inserted between the moving core 40 and the main body inside upper surface 21*a* in the axis line direction.

As shown in FIG. 10, in the axis line direction, a separation distance H1*a* between the cover upper surface 90*b* and the second inner lower surface 52*a* is the same as a separation distance H1*b* between the cover lower surface 90*c* and the main body inside upper surface 21*a*. In the axis line direction, a separation distance H2*a* between the fixed boundary portion Q and the second inner lower surface 52*a* is the same as a separation distance H2*b* between the fixed boundary portion Q and the main body inside upper surface 21*a*. In those cases, in the axis line direction, the cover outer portion 91 and the fixed boundary portion Q are located at the center positions of the second inner lower surface 52*a* and the main body inside upper surface 21*a*.

In FIGS. 9 and 10, the separation distance between the cover inner portion 92 and the moving core 40 in the axis line direction increases or decreases with the movement of the movable structure M, but the valve body 30 is seated on the seating surface 23*s* so that the cover inner portion 92 and the moving core 40 come out of contact with each other. In the present embodiment, a space between the cover upper surface 90*b* and the moving core 40 and the second stationary core 502 is referred to as a cover upper chamber S1, and a space between the cover lower surface 90*c* and the main body portion 21 is referred to as a cover lower chamber S2. The cover upper chamber S1 and the cover lower chamber S2 are formed in a state in which the cover body 90 enters into the main body notch portion N21 and the second notch portion N51. The cover upper chamber S1 is included in the flow passage F26*s*, and the cover lower chamber S2 is included in the flow passage F31.

The cover body 90 is formed of a cover member 93 and a facing member 94. Each of the cover member 93 and the facing member 94 is a toric member made of metal, and the facing member 94 is provided on an inner peripheral side of the cover member 93. The facing member 94 is fitted to the inner peripheral surface of the cover member 93, and the facing member 94 and the cover member 93 are joined to each other at a boundary portion between those members by welding or the like. The cover member 93 has a portion near an outer peripheral surface included in the cover outer portion 91 and a portion near an inner peripheral surface included in the cover inner portion 92. On the other hand, the facing member 94 is entirely included in the cover inner portion 92. The facing member 94 configures a facing portion and is supported by the cover member 93.

The facing member 94 has a facing inner surface 94*a*, and is located on an outer peripheral side of the sliding member 33 in the radial direction. The facing inner surface 94*a* faces the sliding surface 33*a* of the sliding member 33 in the radial direction, and the sliding surface 33*a* of the sliding member 33 slides on the facing inner surface 94*a*. In that case, a member on the nozzle body 20 side which slides the sliding surface 33*a* described above is formed of the facing member 94. The facing inner surface 94*a* is an inner peripheral surface of the facing member 94, and a height dimension of the facing inner surface 94*a* is smaller than a height dimension of the sliding surface 33*a* in the axis line direction. Both of the facing inner surface 94*a* and the sliding surface 33*a* extend parallel to the axis line direction. A diameter of the sliding surface 33*a* is slightly smaller than a diameter of the facing inner surface 94*a*. In other words, a position of the sliding surface 33*a* in a direction orthogonal to a slidable direction of the sliding member 33 is located on an inner side of an outermost peripheral position of the facing inner surface 94*a*, that is, on the side of the annular center line C.

The facing member 94 also functions as a guide portion for guiding the moving direction of the movable structure M by sliding the sliding member 33 on the facing member 94. In that case, the facing inner surface 94*a* may be referred to as a guide surface or a guiding surface. The facing member 94 configures a guide portion.

Like the non-magnetic member 60 and the main body portion 21, the cover member 93 and the facing member 94 are low in magnetism than the stationary core 50 and the moving core 40, and are made of, for example, a nonmagnetic material. For that reason, the cover member 93 and the facing member 94 are less likely to form magnetic flux passages. However, the facing member 94 is preferably made of a material having high hardness and strength so that the facing inner surface 94*a* is less likely to be worn or deformed even when the sliding member 33 slides. According to the present embodiment, the high hardness and strength are given priority to the material of the facing member 94, and the magnetism of the facing member 94 is higher than that of the cover member 93, the non-magnetic member 60, and the main body portion 21. In that case, the facing member 94 is more likely to form a path of the magnetic flux than the cover member 93, and so on. However, the magnetism of the facing member 94 is lower than that of the stationary core 50 or the moving core 40, and is less likely to form a path of the magnetic flux than that of the stationary core 50, and so on.

As described above, the fixed boundary portion Q is included in a portion where the second stationary core 502 and the main body portion 21 are welded together, and the portion is referred to as a welded portion 96. The welded portion 96 is located in a portion extending from an outer end portion of the fixed boundary portion Q in the radial direction to a predetermined depth range, and the weld portion 96 includes a part of the cover body 90 in addition to parts of the second stationary core 502 and the main body portion 21. With respect to the cover body 90, a portion of the cover member 93 forming the cover outer portion 91 is included in the welded portion 96. A depth dimension of the welded portion 96 in the radial direction is larger than a width dimension of the fixed boundary portion Q by an amount including a part of the cover member 93. The welded portion 96 is a portion of the second stationary core 502, the main body portion 21, and the cover member 93, which is melted and mixed by heating and then cooled and solidified. In the welded portion 96, three members including the second stationary core 502, the main body portion 21, and the cover member 93 are joined together.

The welded portion 96 is illustrated in halftone dots in FIG. 10 where the fixed boundary portion Q is illustrated in a virtual line in FIG. 10. On the other hand, in FIG. 9 and the like other than FIG. 10, although the illustration of the welded portion 96 is omitted, in reality, as shown in FIG. 10, each part of the second stationary core 502, the main body portion 21, and the cover member 93 and the fixed boundary portion Q disappear by the welded portion 96. For that reason, the cover body 90 actually covers the welded portion 96 from the radially inner side rather than the fixed boundary portion Q, but in the present embodiment, it is described synonymously that the cover body 90 covers the welded portion 96 and the cover body 90 covers the fixed boundary portion Q.

The elastic member SP1 is a coil spring, and has a coil shape in which a wire extends spirally around an annular center line C. The entirety of the elastic member SP1 is located on the opposite side of the nozzle hole 23*a* from the movable inner upper surface 42*a* in the axial direction. In other words, a abutment surface between the elastic member SP1 and the orifice member 32 is located on the counter-nozzle hole side with respect to the movable inner upper surface 42*a*.

Next, the operation of the fuel injection valve 1 will be described.

When the coil 70 is energized, a magnetic field is generated around the coil 70. For example, as shown by a broken line in FIG. 11, a magnetic field circuit in which a magnetic flux passes through the stationary core 50, the moving core 40, and the yoke 75 is formed with energization, and the moving core 40 is attracted to the stationary core 50 by a magnetic force generated by the magnetic circuit. In that case, the first lower surface 50*a* and the movable inner upper surface 42*a* in the first stationary core 501 and the moving core 40 are attracted to each other by a path of the magnetic flux. Similarly, the second stationary core 502 and the moving core 40 are attracted to each other by the second inner lower surface 52*a* and the movable outer upper surface 43*a* serving as a passage for magnetic flux. Therefore, the first lower surface 50*a*, the movable inner upper surface 42*a*, the second inner lower surface 52*a*, and the movable outer upper surface 43*a* may be referred to as attracting surfaces. In particular, the movable inner upper surface 42*a* corresponds to a first attracting surface, and the movable outer upper surface 43*a* corresponds to a second attracting surface. An attraction direction coincides with the axis line direction described above. The first attracting surface and the second attracting surface are provided at positions different from each other in the moving direction of the movable structure M.

The non-magnetic member 60 prevents the first stationary core 501 and the second stationary core 502 from being magnetically short-circuited by not serving as a path of the magnetic flux. An attractive force between the moving core 40 and the first stationary core 501 is generated by the magnetic flux passing through the movable inner upper surface 42*a* and the first lower surface 50*a*, and an attractive force between the moving core 40 and the second stationary core 502 is generated by the magnetic flux passing through the movable outer upper surface 43*a* and the second lower surface 51*a*. The magnetic flux passing through the stationary core 50 and the moving core 40 includes not only the yoke 75 but also the magnetic flux passing through the case 10.

In addition, the magnetic flux is inhibited from passing through the main body portion 21 and the cover body 90 because the magnetism of the main body portion 21 and the cover body 90 is lower than that of the stationary core 50 and the like. As described above, in the facing member 94, the magnetism becomes higher to some extent by giving priority to the hardness and strength that can withstand the sliding of the sliding member 33. However, since the magnetism of the cover member 93 is sufficiently low, the cover member 93 inhibits the magnetic flux passing through the second stationary core 502 from reaching the facing member 94.

Figure 12:
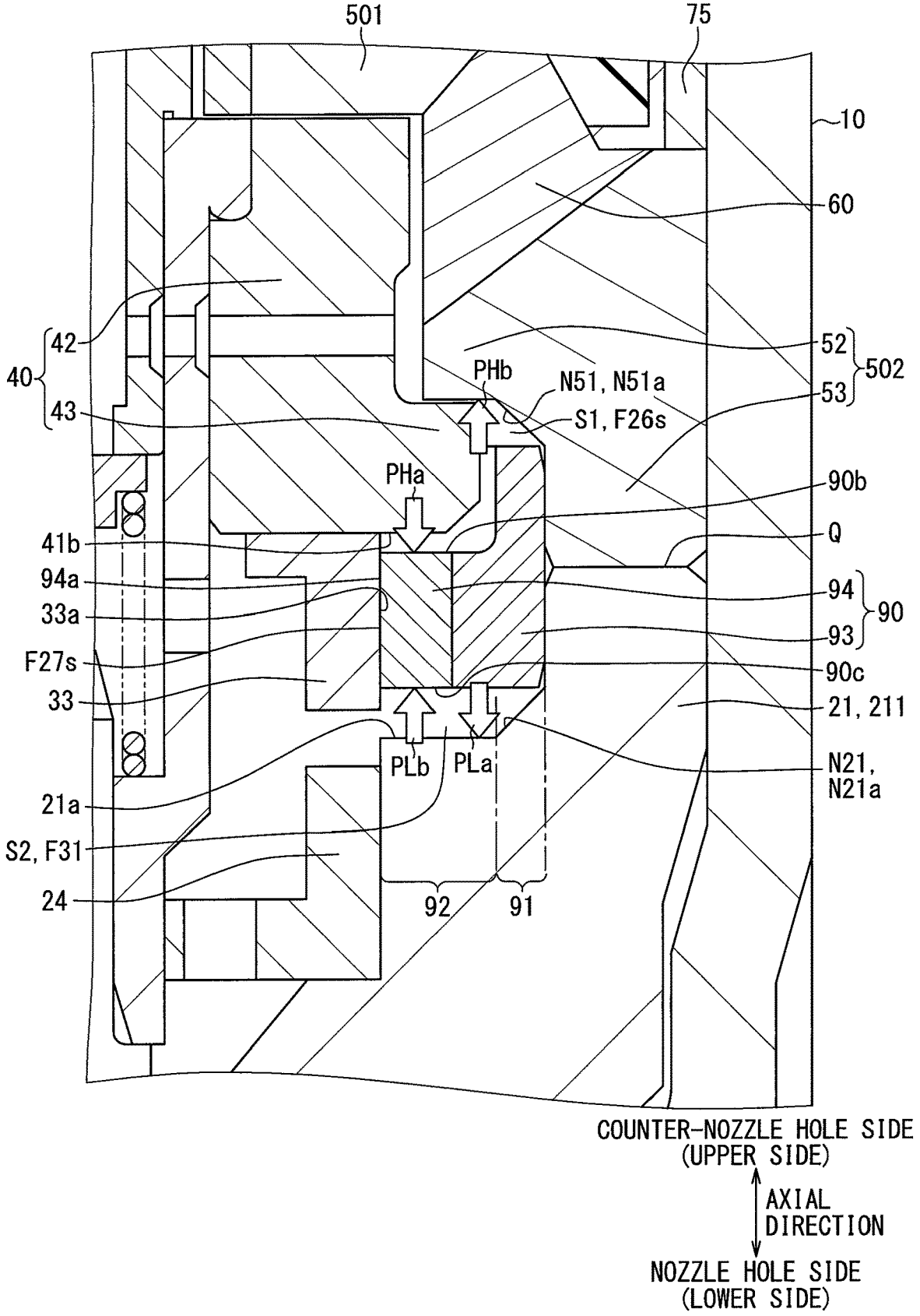
FIG. 12 is a diagram illustrating a relationship between the cover body and a fuel pressure.

Next, a relationship between the cover body 90 and the fuel pressure will be described with reference to FIG. 12.

In the cover upper chamber 51 on the counter-nozzle hole side of the cover body 90, an upper chamber downward fuel pressure PHa and an upper chamber upward fuel pressure PHb corresponding to the upstream fuel pressure PH are generated because the cover upper chamber S1 is included in the upstream region. The upper chamber downward fuel pressure PHa is a pressure that pushes the cover body 90 downward toward the nozzle hole side, and is applied to both of the cover outer portion 91 and the cover inner portion 92. For example, the cover upper surface 90*b* is pushed downward. On the other hand, the upper chamber upward fuel pressure PHb is a pressure that pushes the second stationary core 502 upward toward the counter-nozzle hole side, and is applied to the second inner portion 52. For example, the second inner lower surface 52*a* is pushed upward.

In the cover lower chamber S2 on the nozzle hole side of the cover body 90, because the cover lower chamber S2 is included in the downstream region, a lower chamber downward fuel pressure PLa and a lower chamber upward fuel pressure PLb corresponding to the downstream fuel pressure PL are generated. The lower chamber upward fuel pressure PLb is a pressure that pushes the cover body 90 upward toward the counter-nozzle hole side, and is applied to both of the cover outer portion 91 and the cover inner portion 92 in the cover lower chamber S2. For example, the cover lower surface 90*c* is pushed upward. On the other hand, the lower chamber downward fuel pressure PLa is a pressure that pushes the main body portion 21 downward toward the nozzle hole side. For example, the main body inside upper surface 21*a* is pushed downward.

As described above, when the fuel pressures PHa, PHb, PLa, and PLb occur on the nozzle hole side and the counter-nozzle hole side of the cover body 90, the upper chamber downward fuel pressure PHa and the lower chamber upward fuel pressure PLb cancel each other through the cover body 90. Similarly, the upper chamber upward fuel pressure PHb and the lower chamber downward fuel pressure PLa cancel each other through the second stationary core 502 and the main body portion 21. Therefore, in the cover upper chamber S1 and the cover lower chamber S2, the pressure is inhibited from acting in the direction in which the second stationary core 502 and the main body portion 21 are vertically separated from each other.

For example, contrary to the present embodiment, in the configuration in which the cover upper chamber S1 is formed but the cover lower chamber S2 is not formed, the pressure for canceling the upper chamber downward fuel pressure PHa is not applied to the cover body 90, and the pressure for canceling the upper chamber upward fuel pressure PHb is not applied to the main body portion 21. For that reason, the upper chamber downward fuel pressure PHa pushes the main body portion 21 together with the cover body 90 downward toward the nozzle hole side, and the upper chamber upward fuel pressure PHb pushes the second stationary core 502 upward toward the counter-nozzle hole side. In that case, the fuel pressures PHa and PHb act in such a manner as to separate the second stationary core 502 and the main body portion 21 from each other, which is not preferable in order to properly maintain a joined state between the second stationary core 502 and the main body portion 21 at the fixed boundary portion Q. On the other hand, in the present embodiment, since the fuel pressures PHa, PHb, PLa, and PLb generated in the cover upper chamber S1 and the cover lower chamber S2 cancel each other as described above, the present embodiment is preferable in order to properly maintain the joined state between the second stationary core 502 and the main body portion 21 at the fixed boundary portion Q.

Next, the function of the cover upper chamber S1 will be described. As described above, during the movement of the movable structure M in the valve closing direction, the fuel flows into the cover upper chamber S1 from the flow passage F31 such as the cover lower chamber S2 through the throttle flow passage F22. In this instance, in the flow passage F26*s*, due to the presence of the flow passage F24*s* and F25*s* on the upstream side of the cover upper chamber S1, the fuel is less likely to flow from the cover upper chamber S1 into the main passage such as the flow passage F21 and the upstream passage F10 such as the flow passage F13. In other words, in order for the fuel to flow out from the cover upper chamber S1 to the main passage or the upstream passage F10, the movable lower surface 41*b* of the moving core 40 needs to approach the cover upper surface 90*b* of the cover body 90 in the axis line direction against the valve closing force of the elastic member SP1. In this manner, when the movable structure M moves in the valve closing direction, the cover upper chamber S1 exerts a damper function to apply a braking force to the movable structure M. For that reason, the valve body 30 is restrained from bouncing to the seating surface 23*s* when the valve is closed, so that the injection state is hardly caused against the intention.

Next, a method of manufacturing the fuel injection valve 1 will be described below. In this example, an assembling procedure after each component is manufactured will be mainly described.

First, the support member 24 is attached to the main body portion 21 of the nozzle body 20. In this example, the support member 24 is inserted inside the main body portion 21, and the main body portion 21 and the support member 24 are fixed to each other by welding or the like.

Next, the cover body 90 is attached to the main body portion 21. In this example, the cover body 90 is manufactured in advance by inserting the facing member 94 inside the cover member 93 and fixing the cover member 93 and the facing member 94 by welding or the like. Then, the cover body 90 is inserted into the main body portion 21. In that case, in the cover body 90, an axial length dimension of the portion that has entered the main body portion 21 and an axial length dimension of the portion that has protruded from the main body portion 21 are set to be substantially the same. A length dimension of the inserted portion corresponds to a separation distance H2*b*, and a length dimension of the protruded portion corresponds to a separation distance H2*a*.

Thereafter, the movable structure M is mounted on the nozzle body 20. The movable structure M is manufactured in advance by assembling the moving core 40, the coupling member 31, the valve body 30, the orifice member 32, the sliding member 33, the moving member 100, and the pressing elastic member SP3 together. In this example, the movable structure M is attached to the nozzle body 20 by inserting the sliding member 33 into the cover body 90 while inserting the valve body 30 into the nozzle portion 22.

Subsequently, the stationary core 50 and the non-magnetic member 60 are attached to the nozzle body 20. In this example, the stationary core 50 is mounted on the non-magnetic member 60, and the non-magnetic member 60 and the stationary core 50 are fixed to each other by welding or the like, thereby manufacturing the core unit in advance. The second stationary core 502 is attached to the main body portion 21 and the cover body 90 by attaching the core unit to the nozzle body 20. In that case, the second lower surface 51*a* of the second stationary core 502 is superimposed on the main body outside upper surface 21*b* of the main body portion 21 while the end portion of the cover body 90 is inserted into the inner side of the second stationary core 502. As a result, the fixed boundary portion Q exists between the second stationary core 502 and the main body portion 21.

Thereafter, a welding operation is performed on the entire circumference of the fixed boundary portion Q from the outer peripheral side with the use of a welding tool to form the welded portion 96. In that case, there is a concern that sputter such as slag or metal grains generated by welding may scatter through the fixed boundary portion Q to an internal space of the second stationary core 502 or the main body portion 21. On the other hand, since the cover body 90 covers the fixed boundary portion Q from the inner peripheral side, even if sputter occurs due to welding, the sputter contacts the cover body 90 and does not further fly to the inner peripheral side. For that reason, the cover body 90 prevents the sputter from protruding from the fixed boundary portion Q to the inner peripheral side.

The welding is carried out in such a way that the welded portion 96 extends beyond the fixed boundary portion Q to reach the cover body 90. In this example, a test is made as to how much temperature and how long a heat is applied when the heat is applied for welding, so that the welded portion 96 reaches the cover body 90 beyond the fixed boundary portion Q. Then, based on the test result, the temperature of the heat to be applied at the time of welding and a duration of the heat to be applied are set. As a result, the welded portion 96 is prevented from reaching no cover body 90.

After forming the welded portion 96, the coil 70, the yoke 75, and the like are mounted on the first stationary core 501, and those components are collectively housed in the case 10 to complete the fuel injection valve 1.

Next, a more detailed configuration of the fuel injection valve 1 described above will be described.

The moving core 40 is a portion of the movable structure M having the movable inner upper surface 42*a* (first attracting surface) and the movable outer upper surface 43*a* (second attracting surface). A portion of the movable structure M that is longer in the axial direction than the moving core 40 is referred to as a long axis member. In the present embodiment, the valve body 30 and the coupling member 31 correspond to a long axis member. The material of the moving core 40 is different from the material of the long axis member.

Specifically, the longitudinal elastic modulus of the long axis member is larger than the longitudinal elastic modulus of the moving core 40. The hardness of the long axis member is higher than the hardness of the moving core 40. Further, a specific gravity of the long axis member is smaller than that of the moving core 40. Further, the moving core 40 is higher in magnetism than the long axis member and is likely to pass the magnetic flux. Further, the long axis member is higher in abrasion resistance than the moving core 40, and is less likely to be worn.

The difference in the longitudinal elastic modulus described above can be confirmed by a tensile test. For example, for each of the moving core 40, the valve body 30, and the coupling member 31, a tensile test is performed to impart a tensile load to break, and a slope in the elastic range of a stress strain characteristic line obtained during a fracture indicates a longitudinal elastic modulus. In the tensile test, each of the moving core 40, the valve body 30, and the coupling member 31 may be cut into a predetermined sample shape, and a tensile load may be applied to a sample product. Alternatively, a tensile load may be directly applied to each of the moving core 40, the valve body 30, and the coupling member 31 without performing the cutting process described above. When the longitudinal elastic modulus is measured for a predetermined number n of sample products by a tensile test, and an mean value of the longitudinal elastic modulus is defined as $\mu$ and a standard deviation of the longitudinal elastic modulus is defined as $\sigma$, and the longitudinal elastic modulus of the long axis member is larger than the longitudinal elastic modulus of the moving core 40 for all the longitudinal elastic modulus included in a range of $\mu \pm 3\sigma$ among the predetermined number n.

Next, the operation and effects of the configuration employed in the present embodiment will be described.

As shown in FIG. 10, a position of the sliding surface 33*a* in a direction perpendicular to the slidable direction of the movable structure M (that is, in the radial direction) is different from the outermost peripheral position of the moving core 40. Specifically, the sliding surface 33*a* is located on the inner diameter side of the outer peripheral surface of the movable outer portion 43 and on the inner diameter side of the outer peripheral surface of the movable inner portion 42. For that reason, an areas S of the upstream side pressure receiving surface SH and the downstream side pressure receiving surface SL can be adjusted without changing the outermost peripheral position of the moving core 40. Therefore, the position of the sliding surface 33*a* is adjusted, thereby being capable of the above area S without changing the outermost peripheral position of the moving core 40. Therefore, the braking force can be adjusted without causing a large change in the magnetic force acting on the moving core 40.

Further, according to the present embodiment, the moving core 40 is formed in a stepped shape having the movable inner upper surface 42*a* (first attracting surface) and the movable outer upper surface 43*a* (second attracting surface) provided at positions different from each other in the axial direction. The directions of the magnetic fluxes of the first attracting surface and the second attracting surface are different from each other. According to the above configuration, contrary to the present embodiment, the magnetic attraction force can be improved as compared with a moving core in which two attracting surfaces having different magnetic flux directions are provided at the same position in the axial direction. The reason will be described below.

A magnetic field strength generated by the coil 70 is highest in the central portion of the coil 70 in the axial direction. In view of this point, in the present embodiment, since the first attracting surface is located closer to the coil 70 than the second attracting surface in the axial direction, the first attracting surface is located closer to the central portion where the magnetic field strength is high. For that reason, the magnetic attraction force can be improved as compared with the moving core in which the first attracting surface is provided at the same position in the axial direction as the second attracting surface.

When the moving core 40 is formed in a stepped shape in this manner, the moving core 40 increases in size, so that a mass of the movable structure M increases. As a result, when the movable structure M is operated to close the valve and the valve body 30 is seated on the seating surface 23*s*, a bounce phenomenon in which the valve body 30 repeatedly collides with the seating surface 23*s* and bounces back is likely to occur. In contrast to the above phenomenon, in the present embodiment, a longitudinal elastic modulus of the valve body 30 (long axis member) and the coupling member 31 (long axis member) is set to be larger than the longitudinal elastic modulus of the moving core 40. According to the above configuration, contrary to the present embodiment, the bounce can be reduced as compared with the case where the longitudinal elastic modulus of the moving core 40 and the long axis member are set to the same. The reason will be described below.

As a result of numerical analysis of the vibration behavior when the movable structure M bounces, a time required for damping vibration becomes shorter as a natural frequency of a vibration model becomes larger. Therefore, increasing the natural frequency of the movable structure M is effective in reducing the bounce. As a vibration direction length L of the vibration model is longer, a natural frequency f becomes shorter, while as a longitudinal elastic modulus E of the vibration model is larger, the natural frequency f becomes larger. For that reason, it is effective in increasing the natural frequency f of the movable structure M to increase the longitudinal elastic modulus E of a portion of the movable structure M having a long axial length.

In view of the above, in the present embodiment, the longitudinal elastic modulus E of the long axis member having a shape longer in the axial direction than that of the moving core 40 is set to be larger than that of the moving core 40. For that reason, since the natural frequency f of the movable structure M can be increased, a time required for damping the bounce vibration can be shortened. Therefore, the moving core 40 can be formed in a stepped shape to be able to perform both of an improvement in the magnetic attraction force and a reduction in the bounce. In addition, since the moving core 40 forming the first attracting surface and the second attracting surface can employ a ferromagnetic material that allows the path of the magnetic flux without being restricted by increasing the longitudinal elastic modulus E, both of an improvement in the magnetic force and a reduction in the bounce can be performed.

Further, according to the present embodiment, the entire elastic member SP1, which is a coiled spring, is located on an opposite side of the nozzle hole 23*a* from the first attracting surface in the axial direction. In this example, contrary to the present embodiment, when a part of the elastic member SP1 is positioned closer to the nozzle hole 23*a* than the first attracting surface in the axial direction, there is a fear that the magnetic flux generated by the energization flows to the elastic member SP1 while bypassing an air gap in the first attracting surface. In addition, since the coil spring has an asymmetric shape, a difference is generated in the attraction force in the circumferential direction of the first attracting surface, so that the force for maintaining the moving core 40 at a full lift position is lowered. As a result, the valve closing speed of the movable structure M increases, and the bounce is promoted. On the other hand, in the present embodiment, since the entire elastic member SP1 is located on the counter-nozzle hole side of the first attracting surface, the bypassing described above can be reduced, and an improvement in the magnetic attraction force can be promoted.

Further, according to the present embodiment, the fixed boundary portion Q is covered from the inner peripheral side by the cover body 90. For that reason, at the time of manufacturing the fuel injection valve 1, the sputter generated by the welding operation from the outer peripheral side can be prevented from scattering in an internal space of the second stationary core 502 or the main body portion 21 through the fixed boundary portion Q. In this instance, the injection of the fuel from the nozzle hole 23*a* can be inhibited from being not properly performed due to the presence of the sputter in the flow passage F26*s*, F31, or the like. As a result, even if the second stationary core 502 and the main body portion 21 are joined together by welding, the fuel can be properly injected.

Further, according to the present embodiment, the non-magnetic member 60 has the upper inclined surface 60*a* and the lower inclined surface 60*b*. For that reason, when the non-magnetic member 60 is assembled to the first stationary core 501 and the second stationary core 502, a coaxial assembly can be realized with a high accuracy. For that reason, when the movable structure M is opened and closed, a resistance of the fuel received by the movable structure M can be made uniform in the circumferential direction. As a result, since the opening and closing operation of the movable structure M becomes smooth, a rapid start of the opening and closing operation makes it possible to reduce an the increase in the traveling speed, and hence the reduction of the bounce can be promoted.

Seventh Embodiment

Figure 13:
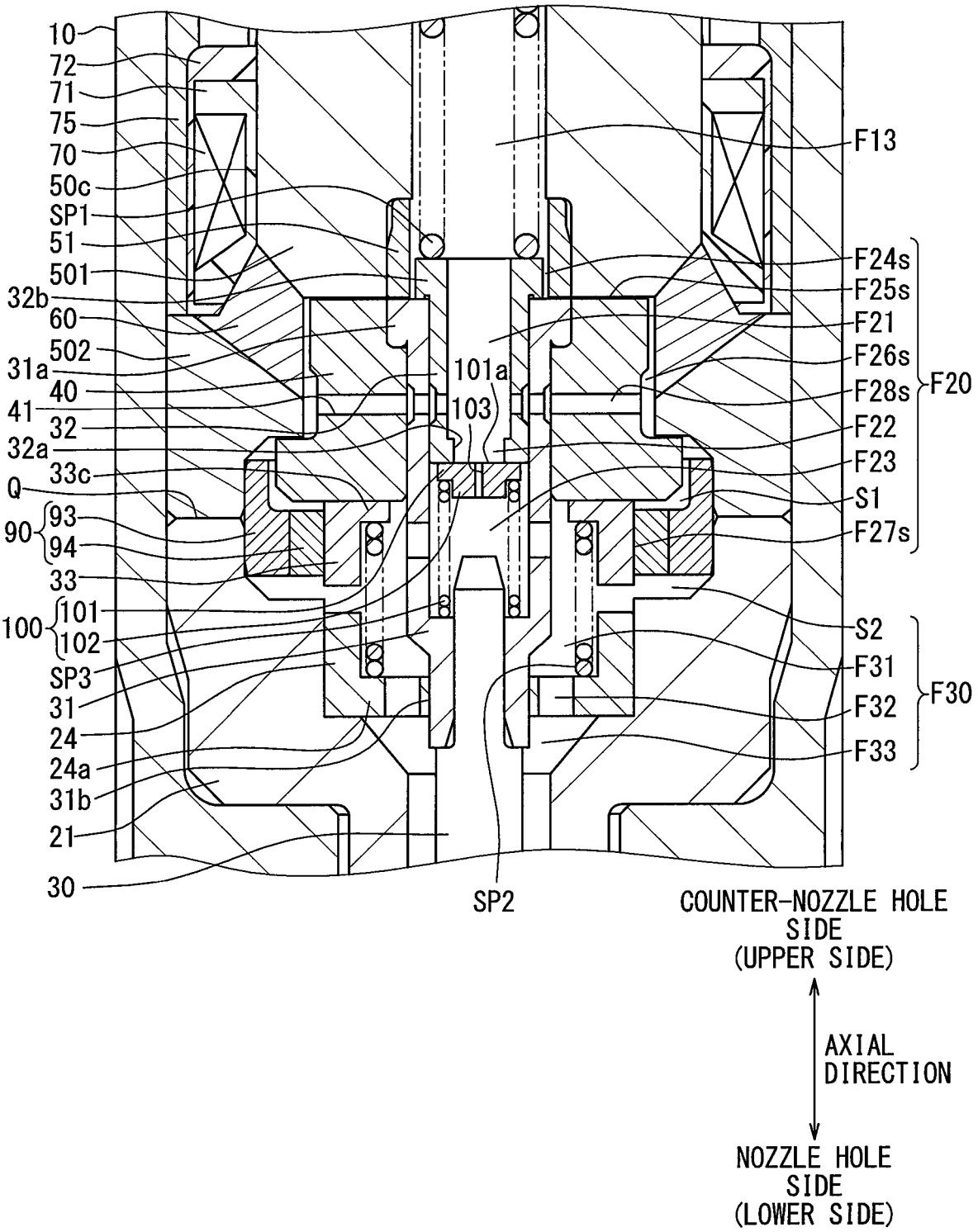
FIG. 13 is an enlarged view of a periphery of the moving core of FIG. 1 according to a seventh embodiment of the present disclosure.

In the sixth embodiment, the sliding member 33 is fixed to the moving core 40 by welding. On the other hand, in the present embodiment, the above-mentioned weld is eliminated, and the sliding member 33 is pressed against a moving core 40 by an elastic force of a close contact elastic member SP2 as shown in FIG. 13. In short, in the present embodiment, the structure shown in FIG. 2 using the close contact elastic member SP2 is combined with the moving core 40 having a stepped shape.

Eighth Embodiment

Figure 14:
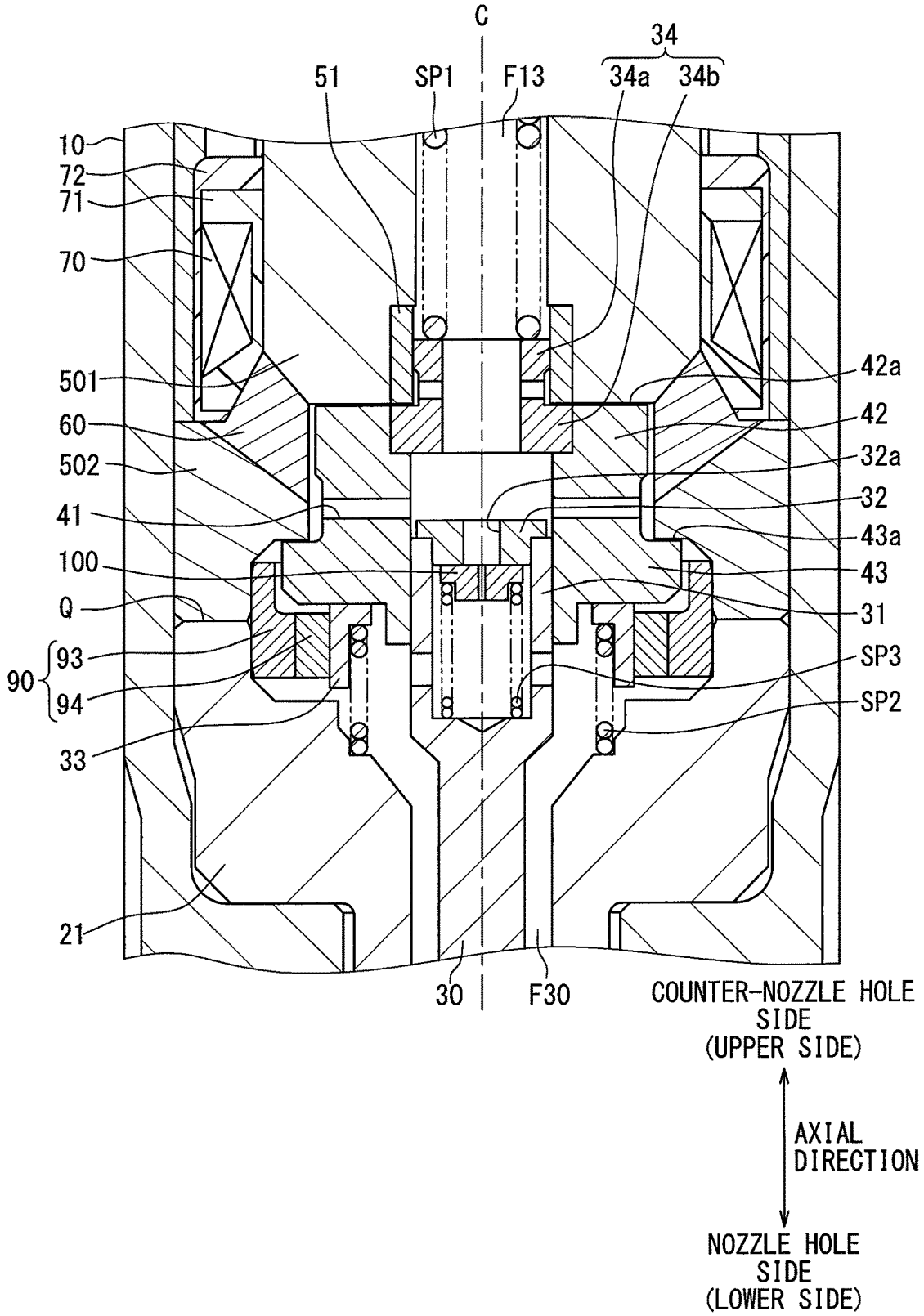
FIG. 14 is an enlarged view of a periphery of the moving core of FIG. 1 according to an eighth embodiment of the present disclosure.

In the seventh embodiment, the movable structure M is supported at two locations in the axial direction from the radial direction. Specifically, the movable structure M is supported at two positions, that is, the counter-nozzle hole side guide portion 31*b* of the coupling member 31 and the nozzle hole side guide portion 30*b* of the valve body 30. On the other hand, in the present embodiment, as shown in FIG. 14, the support member 24 supporting the counter-nozzle hole side guide portion 31*b* is eliminated, and a guide member 34 is provided in a movable structure M. The movable structure M is supported at two positions, that is, the guide member 34 and the nozzle hole side guide portion 30*b*.

The guide member 34 has a cylindrical shape assembled to an upper end of the moving core 40, and a cylindrical inside of a flow passage F13 functions as an internal flow passage F13. The guide member 34 has a guide portion 34*a* and a fixed portion 34*b*. The fixed portion 34*b* is fixed to a movable inner portion 42 by welding, and the guide portion 34*a* is located on a counter-nozzle hole side of the fixed portion 34*b*. The outer peripheral surface of the guide portion 34*a* is restricted from moving in the radial direction while sliding on an inner peripheral surface of the stopper 51. A surface of the fixed portion 34*b* on the counter-nozzle hole side abuts on an end face of the stopper 51 on the nozzle hole side, thereby restricting the movement of the movable structure M to the counter-nozzle hole side.

In short, the guide member 34 has both of a supporting function by the counter-nozzle hole side guide portion 31*b* according to the first embodiment and a stopper function by the enlarged diameter portion 31*a*. In the present embodiment, the coupling member 31 is formed integrally with the valve body 30, and the enlarged diameter portion 31*a* is removed from the coupling member 31. In addition, in the present embodiment, the end face of the close contact elastic member SP2 is supported by the main body portion 21 in association with the elimination of the support member 24.

OTHER EMBODIMENTS

Although the preferred embodiments of the present disclosure have been described above, the present disclosure is not limited to the embodiments described above, and can be implemented by various modifications as exemplified below. Not only combinations of portions clearly indicating that specific combinations are possible in the respective embodiments, but partial combinations of the embodiments are possible even if the combinations are not clearly indicated, unless there is a problem in the combinations in particular.

In the first embodiment, the sliding member 33 is installed in a state of being able to move relative to the moving core 40 in the radial direction. On the other hand, the sliding member 33 may be secured to the moving core 40 by a measure such as welding and placed in a relatively non-movable state.

In the first embodiment, the moving core 40 and the coupling member 31 are separately cut and manufactured as separate parts, and then the moving core 40 and the coupling member 31 are combined and integrated together by welding or the like. On the other hand, the moving core 40 and the coupling member 31 may be integrally manufactured as one part. For example, one metal base material may be cut to integrally form the moving core 40 and the coupling member 31.

In the first embodiment, the coupling member 31 and the valve body 30 are separately machined and manufactured as separate parts, and then the coupling member 31 and the valve body 30 are combined and integrated together by welding or the like. On the other hand, the coupling member 31 and the valve body 30 may be integrally manufactured as one part. For example, the coupling member 31 and the valve body 30 may be integrally formed by cutting one metal base material.

In the first embodiment, the moving core 40, the coupling member 31, and the valve body 30 are separately machined and manufactured as separate parts, but the moving core 40, the coupling member 31, and the valve body 30 may be integrally manufactured as one part. For example, one metal base material may be cut to integrally form the moving core 40, the coupling member 31, and the valve body 30.

In the first embodiment, the valve body 30 is secured to the moving core 40 by a measure such as welding and is mounted in an axially non-movable condition. On the other hand, the valve body 30 may be located in a state of being able to move relative to the moving core 40 in the axis line direction. In that case, even after the valve body 30 engages with the moving core 40, a driving force of the moving core 40 is transmitted to the valve body 30, and the moving core 40 is attracted by the stationary core 50 and stops at the time of the valve opening operation, the valve body 30 is relatively movable. In the valve closing operation, when the valve body 30 is pushed by the elastic member SP1 to perform the valve closing operation, the valve body 30 engages with the moving core 40, a valve closing force of the valve body 30 is transmitted to the moving core 40, and even after the valve body 30 is seated and the valve closing operation is stopped, the moving core 40 is relatively movable.

In each of the embodiments described above, the throttle flow passage F22 is located at the axis center of the movable structure M. On the other hand, the throttle flow passage F22 may be located at a position deviated from the axis center of the movable structure M. In that case, instead of providing the throttle flow passage F22 into the orifice member 32, the throttle flow passage F22 may be provided in the moving core 40, provided in the coupling member 31, or provided in the valve body 30. In addition, the throttle flow passage F22 may be located at the axis center, and another throttle flow passage may be further provided. For example, another throttle flow passage may be provided in the moving core 40 in addition to the throttle flow passage F22.

When the throttle flow passage F22 is located off the axial center as described above, it is desirable to arrange the multiple throttle flow passages F22 at positions symmetrical with respect to the axis center of the movable structure M. According to the above configuration, the braking force acting on the movable structure M can be inhibited from being biased from the axis center, and a tilting force acting on the movable structure M can be reduced.

In the first embodiment, the position of the sliding surface 33*a* in the direction perpendicular to the slidable direction of the sliding member 33 (in the radial direction), is located inside the outermost peripheral position of the moving core 40, that is, on the side of the annular center line C. On the other hand, the position of the sliding surface 33*a* may be located outside the outermost peripheral position of the moving core 40.

In the embodiments described above, a sliding portion in which the sliding surface 33*a* slides is formed in the nozzle body 20, which is a portion of the body B which accommodates the movable structure M. Alternatively, the above sliding portion may be formed on another component different from the nozzle body 20, and the other component may be coupled to the nozzle body 20.

In the embodiments described above, the flow passage F33 is provided between the sliding surface 33*a* and the body B, but the fuel may not flow. Alternatively, the fuel flowing through the flow passage F33 may be made minute. The minute fuel is, for example, a fuel that is pushed out from a sliding gap as the sliding surface 33*a* slides with the body B.

In the embodiments described above, although the sliding surface 33*a* and the body B is slid, the flow passage F33 may be provided without sliding. In other words, the movable structure M may be a structure accommodated in the body B while being movable in the axial direction without contacting the body B, and the sliding flow passage F27*s* may be a flow passage (separate flow passage) that does not slide.

In the second and third embodiments, the moving member 100 is opened and closed so as to be unseated and seated by the pressure difference ΔP between the downstream fuel pressure PL and the upstream fuel pressure PH and the elastic force of the pressing elastic member SP3. On the other hand, the moving member 100 may be opened and closed by an electric actuator. Alternatively, the moving member 100 per se may be elastically deformed to open and close, thereby eliminating the pressing elastic member SP3.

In the example shown in FIG. 4, a passage length of the sub-throttle flow passage 103 (length in the axis line direction) is longer than a diameter of the sub-throttle flow passage 103, but may be shorter than the diameter. For example, instead of forming the entire length in the axis line direction of the moving member 100 as the sub-throttle flow passage 103, a diameter of a part of the passage length may be reduced to function as the sub-throttle flow passage.

In the fourth embodiment, the sliding member 33 is bonded to the moving core 40, but may be bonded to the coupling member 31 or may be bonded to both of the moving core 40 and the coupling member 31. In the fourth embodiment, the sliding member 33 processed separately from the moving core 40 is joined to the moving core 40, but the sliding member 33 may be integrally processed with the moving core 40. For example, one metal base material may be cut so that the moving core 40 may be formed in a shape having a portion (sliding portion) functioning as the sliding member 33. Even in that case, a surface of the moving core 40 corresponding to the sliding surface 33*a* is provided at a position different from the outermost peripheral position of the moving core 40.

In the fifth embodiment, the orifice 32*a* is provided directly in the moving core 40, and the flow passage F28*s* provided by the through hole 41 is provided as one part of the moving core 40. On the other hand, the orifice 32*a* may be provided directly in the moving cores 40, and the flow passage F28*s* provided by the through holes 41 may be provided by multiple components. In the embodiments described above, the sliding flow passage F27*s* (separate flow passage) is provided on the nozzle hole side with respect to the moving cores 40, but may be provided on the counter-nozzle hole side.

The moving core 40 of the fuel injection valve according to the sixth to eighth embodiments has a stepped shape in which the first attracting surface and the second attracting surface are provided at different positions in the axial direction. On the other hand, the moving core may have a shape in which the first attracting surface and the second attracting surface are provided at the same position in the axial direction. For example, the moving core may have a flat plate shape in which the first attracting surface and the second attracting surface are located on the same plane, and the orientation of the magnetic flux passing through the first attracting surface and the orientation of the magnetic flux passing through the second attracting surface are different from each other.

Figure 15:
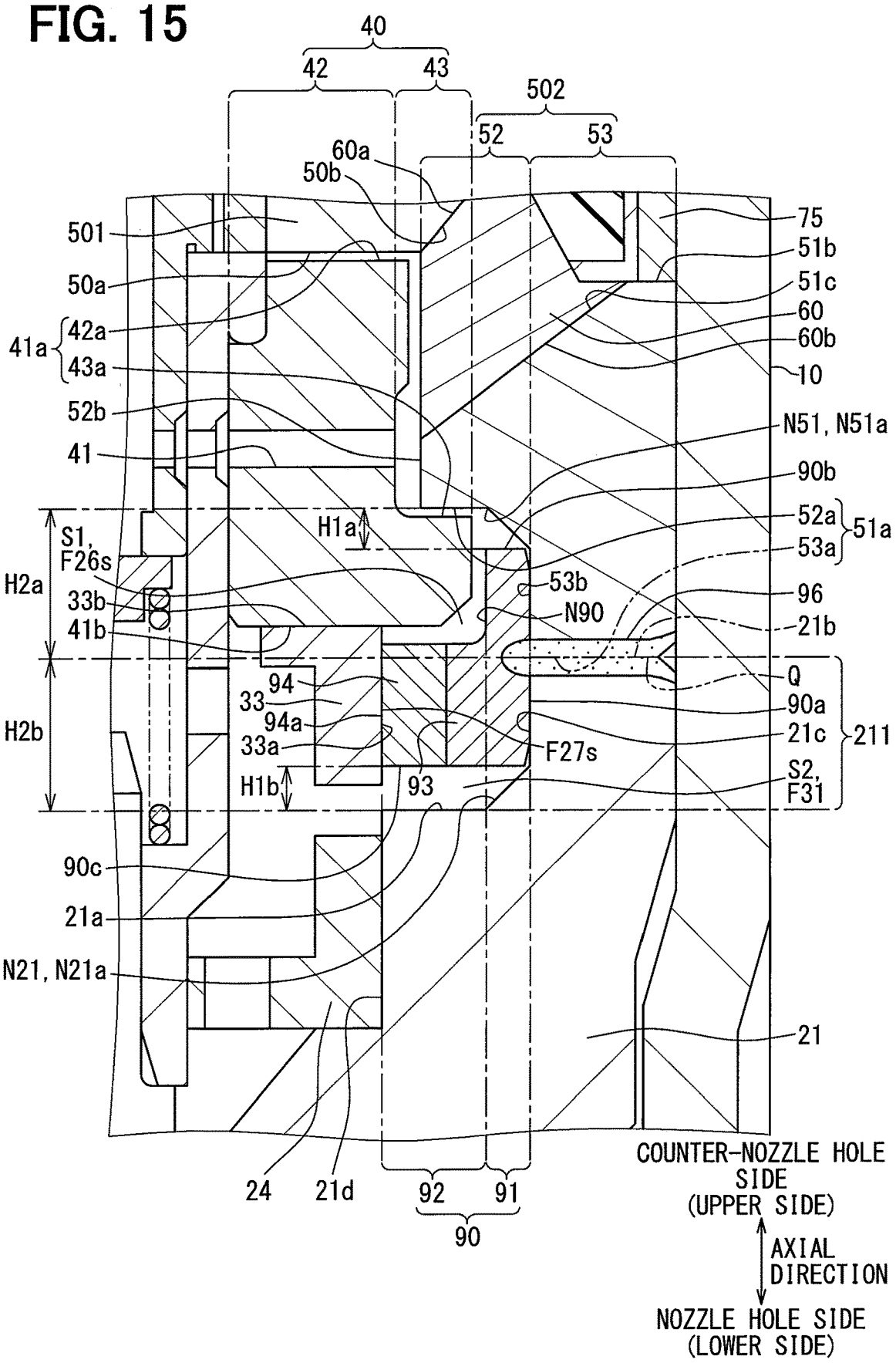
FIG. 15 is a cross-sectional view of a fuel injection valve according to another embodiment.

In each of the embodiments described above, a portion of the stopper 51 protruding toward the nozzle hole side from the first stationary core 501 is formed by the protrusion portion that secures the gap between the stationary core 50 and the moving core 40, but the protrusion portion may be provided in the movable structure M. For example, as shown in FIG. 15, in the movable structure M, the coupling member 31 protrudes from the moving core 40 to the counter-nozzle hole side, and the protruding portion forms a protrusion portion. In the above configuration, the stopper 51 does not protrude toward the nozzle hole side from the first stationary core 501. For that reason, when the movement of the movable structure M is restricted by the abutment between the coupling member 31 and the stopper 51, a gap is secured between the stationary core 50 and the moving core 40 by a length corresponding to the protrusion of the coupling member 31 from the moving core 40.

In each of the embodiments described above, the gap between the first attracting surface and the stationary core and the gap between the second attracting surface and the stationary core may be set to the same size or different sizes. In the case of setting the above gasps to different sizes, it is desirable to set the gap of one of the first attracting surface and the second attracting surface, which is smaller in the amount of magnetic flux passing through each attracting surface, to be larger than that of the other attracting surface. The reason will be described below.

In a state in which a thin film of fuel is filled between the stationary core and the attracting surface, the attracting surface is less likely to be peeled off from the stationary core by a linking action. As the gap between the stationary core and the attracting surface is smaller, the linking action is larger, and a responsiveness of the start of the valve closing operation to the energization off is lowered. However, if the gap is increased in order to reduce the linking action, the attraction force is reduced as a backlash. In view of the above point, it is effective to increase the gap to reduce the linking action because the attracting surface which is smaller in the amount of magnetic flux of the attracting surface does not greatly contribute to an improvement of the attraction force even if the gap is decreased.

As described above, it is desirable that the gap of one of the first attracting surface and the second attracting surface, which is smaller in the amount of magnetic flux, is set to be larger than that of the other attracting surface. In the examples of the embodiments described above, the amount of magnetic flux passing through the attracting surface (second attracting surface) located on the radially outer side is smaller than the amount of magnetic flux passing through the attracting surface (first attracting surface) located on the radially inner side. Therefore, the gap of the second attracting surface is set to be larger than the gap of the first attracting surface.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

The invention claimed is:

1. A fuel injection valve having a nozzle hole configured to inject a fuel and a flow passage configured to cause the fuel to flow through the nozzle hole, the fuel injection valve comprising:

a coil configured to generate a magnetic flux on energization;

a stationary core configured to form a path of the magnetic flux to generate a magnetic force;

a movable structure that includes a moving core movable by the magnetic force and a valve body configured to be driven by the moving core to open and close the nozzle hole, the movable structure internally having a movable flow passage which is a part of the flow passage; and a body that internally accommodates the movable structure in a movable state and internally has a part of the flow passage, wherein the movable structure includes a throttle portion at which a passage area of the movable flow passage is partially throttled to regulate a flow rate, the flow passage includes a throttle flow passage defined by the throttle portion and a separate flow passage between the movable structure and the body to cause the fuel to flow independently of the throttle flow passage, a passage area of the separate flow passage is smaller than a passage area of the throttle flow passage, and a position of the separate flow passage in a direction perpendicular to a moving direction of the movable structure is different from an outermost peripheral position of the moving core.

2. The fuel injection valve according to claim 1, wherein a nozzle hole side portion of the separate flow passage is connected to a flow passage closer to the nozzle hole than the throttle flow passage, and a portion of the separate flow passage on a counter-nozzle hole side opposite to the nozzle hole is connected to a flow passage on the counter-nozzle hole side of the throttle flow passage.

3. The fuel injection valve according to claim 1, wherein the separate flow passage is closer to the nozzle hole than the moving core.

4. The fuel injection valve according to claim 1, wherein the separate flow passage is provided on the radially inner side of an outermost circumference of the moving core.

5. The fuel injection valve according to claim 1, wherein a material of a member defining the separate flow passage in the movable structure is different from a material of the moving core.

6. The fuel injection valve according to claim 1, wherein the moving core has a through hole that communicates a portion of the throttle flow passage on the counter-nozzle hole side opposite to the nozzle hole with a portion of the separate flow passage on the counter-nozzle hole side.

7. The fuel injection valve according to claim 6, wherein the moving core has the throttle flow passage and a communication flow passage, and the communication flow passage is located on the counter-nozzle hole side of the throttle flow passage and communicates with the throttle flow passage and the through hole.

8. The fuel injection valve according to claim 1, wherein the throttle flow passage is defined in the moving core.

9. The fuel injection valve according to claim 1, wherein a passage area of a flow passage between an outermost circumference of the moving core and the body is larger than a passage area of the separate flow passage.

10. The fuel injection valve according to claim 1, wherein when a passage area of the flow passage on a seat surface from and on which the valve body is configured to be unseated and seated, and which is a passage area in a full lift state in which the valve body has moved most in a valve opening direction is defined as a seat passage area, a passage area of the throttle flow passage is larger than the seat passage area.

11. The fuel injection valve according to claim 1, wherein the throttle flow passage is located on a center axis line of the valve body.

12. The fuel injection valve according to claim 1, wherein the movable structure has a variable throttle mechanism configured to change a degree of regulating of a flow rate in the flow passage.

13. The fuel injection valve according to claim 12, wherein the degree of throttling by the variable throttle mechanism is greater at least in a period immediately before closing of the valve in a descending period in which the valve body moves in a valve closing direction than that in a full lift state in which the valve body moves most in a valve opening direction.

14. The fuel injection valve according to claim 12, wherein the degree of throttling by the variable throttle mechanism is greater at least in a period immediately after opening of the valve in an ascending period in which the valve body moves in a valve opening direction than that in the full lift state in which the valve body moves most in the valve opening direction.

15. The fuel injection valve according to claim 12, wherein the variable throttle mechanism includes a fixed member having the throttle portion formed therein and a moving member movable relative to the fixed member, and the moving member is configured to be seated on the fixed member to cover the throttle flow passage to increase the degree of throttling and to be unseated from the fixed member to open the throttle flow passage to decrease the degree of throttling.

16. The fuel injection valve according to claim 15, wherein the moving member is located on a downstream side of the fixed member, and the moving member is configured to be unseated when an upstream side fuel pressure of the moving member becomes higher than a downstream side fuel pressure by a predetermined value or more as the valve body moves in the valve opening direction, and the moving member is configured to be seated when the downstream side fuel pressure becomes higher than the upstream side fuel pressure by a predetermined value or more as the valve body moves in the valve closing direction.

17. The fuel injection valve according to claim 15, wherein the moving member is provided with a sub-throttle flow passage 103 that is a part of the flow passage, and a passage area of the sub-throttle flow passage is smaller than a passage area of the throttle flow passage.

18. The fuel injection valve according to claim 15, wherein the moving member closes the throttle flow passage in a state of being seated on the fixed member.

19. The fuel injection valve according to claim 1, wherein the movable structure includes a sliding member having a sliding surface slidable with the body and a close contact elastic member which presses the sliding member against the moving core to be in close contact with the moving core.

20. The fuel injection valve according to claim 1, wherein the moving core has a first attracting surface and a second attracting surface configured to be attracted to the stationary core by the magnetic force, and an orientation of a magnetic flux passing through the first attracting surface and an orientation of magnetic flux passing through the second attracting surface are different from each other.

21. The fuel injection valve according to claim 20, wherein the first attracting surface and the second attracting surface are provided at different positions from each other in the moving direction of the movable structure.

22. A fuel injection valve having a nozzle hole configured to inject a fuel and a flow passage configured to cause the fuel to flow through the nozzle hole, the fuel injection valve comprising:

a coil configured to generate a magnetic flux on energization;

a stationary core configured to form a path of the magnetic flux to generate a magnetic force;

a movable structure that includes a moving core movable by the magnetic force and a valve body configured to be driven by the moving core to open and close the nozzle hole, the movable structure internally having a movable flow passage which is a part of the flow passage; and a body that internally accommodates the movable structure in a slidable state and internally has a part of the flow passage, wherein the movable structure includes a throttle portion at which a passage area of the movable flow passage is partially throttled to regulate a flow rate and a sliding surface slidable with the body, the flow passage includes a throttle flow passage defined by the throttle, and a position of the sliding surface in a direction perpendicular to a slidable direction of the movable structure is different from an outermost peripheral position of the moving core.

* * * * *